US007186677B2

(12) United States Patent
Rähse et al.

(10) Patent No.: US 7,186,677 B2
(45) Date of Patent: Mar. 6, 2007

(54) METHOD FOR THE PRODUCTION OF SURFACTANT GRANULATES CONTAINING BUILDERS

(75) Inventors: Wilfried Rähse, Düsseldorf (DE); Bernhard Orlich, Düsseldorf (DE); Henriette Weber, Vienna (AT)

(73) Assignee: Henkel Kommanditgesellschaft Auf Aktien (Henkel KGAA), Duesseldorf (DE)

( * ) Notice: Subject to any disclaimer, the term of this patent is extended or adjusted under 35 U.S.C. 154(b) by 0 days.

(21) Appl. No.: 10/872,813

(22) Filed: Jun. 21, 2004

(65) Prior Publication Data

US 2005/0020469 A1 Jan. 27, 2005

Related U.S. Application Data

(63) Continuation of application No. PCT/EP02/14124, filed on Dec. 12, 2002.

(30) Foreign Application Priority Data

Dec. 21, 2001 (DE) ..... 101 63 603

(51) Int. Cl.
*C11D 11/04* (2006.01)

(52) U.S. Cl. ..... 510/444; 510/495; 510/509; 510/536; 23/313 R; 264/117; 562/115

(58) Field of Classification Search ..... 510/444, 510/495, 509, 536; 23/313 R, 313 FB; 264/117; 562/115

See application file for complete search history.

(56) References Cited

U.S. PATENT DOCUMENTS

| | | | | |
|---|---|---|---|---|
| 3,425,948 | A * | 2/1969 | Otrhalek et al. | 510/455 |
| 5,066,425 | A * | 11/1991 | Ofosu-Asante et al. | 510/536 |
| 5,108,642 | A * | 4/1992 | Aszman et al. | 510/375 |
| 5,447,651 | A * | 9/1995 | Karpusiewicz et al. | 510/452 |
| 5,527,489 | A * | 6/1996 | Tadsen et al. | 510/294 |
| 5,616,550 | A | 4/1997 | Kruse et al. | |
| 6,133,223 | A * | 10/2000 | Sampaio et al. | 510/444 |
| 6,174,851 | B1 * | 1/2001 | Harth et al. | 510/444 |
| 6,468,957 | B1 * | 10/2002 | Larson et al. | 510/444 |
| 6,683,042 | B1 * | 1/2004 | Larson et al. | 510/444 |
| 2001/0046950 | A1 * | 11/2001 | Agrawal et al. | 510/141 |

FOREIGN PATENT DOCUMENTS

| | | | |
|---|---|---|---|
| DE | 42 16 629 | A1 | 11/1993 |
| DE | 42 32 874 | A1 | 3/1994 |
| DE | 43 14 885 | A1 | 11/1994 |
| DE | 197 35 788 | A1 | 2/1999 |
| DE | 198 44 523 | A1 | 3/2000 |
| DE | 198 55 380 | A1 | 6/2000 |
| EP | 0 265 203 | B1 | 4/1991 |
| EP | 0 211 493 | B1 | 7/1991 |
| EP | 0 438 320 | A2 | 7/1991 |
| EP | 0 534 525 | A2 * | 3/1993 |
| EP | 0 555 622 | A1 | 8/1993 |
| EP | 0 642 576 | B1 | 7/1996 |
| EP | 0 402 112 | B1 | 8/1996 |
| EP | 0 508 543 | B1 | 8/1997 |
| EP | 0 772 674 | B1 | 6/1998 |
| EP | 0 507 402 | B1 | 2/1999 |
| EP | 0 936 269 | A1 | 8/1999 |
| EP | 0 678 573 | B1 | 11/2000 |
| JP | 09 241698 | | 9/1997 |
| WO | WO 92/01778 | A1 * | 2/1992 |
| WO | WO 98/20104 | A1 | 5/1998 |
| WO | WO 99/00475 | A1 | 1/1999 |
| WO | WO 00/18872 | A1 * | 4/2000 |
| WO | WO 00/34422 | A2 * | 6/2000 |

OTHER PUBLICATIONS

Database WPI, Section Ch, Week 199747, Derwent Publications Ltd., London, GB; AN 1997-509169 XP002134095 of JP 09 241698 (1997).

W. Pietsch, "Size Enlargement by Agglomeration", Verlag Wiley (1991).

Donald W. Breck, "Zeolite Molecular Sieves", John Wiley & Sons, New York, London, Sydney, Toronto, p. 92-116 (1974).

* cited by examiner

*Primary Examiner*—Lorna M. Douyon
(74) *Attorney, Agent, or Firm*—Woodcock Washburn LLP

(57) ABSTRACT

Provided is a method for producing surfactant granulates, comprising (a) providing a mixture of anionic surfactant acids and builder acids having a weight ratio of 1:100 to 1:20 of builder acid to surfactant acid; and (b) contacting the mixture with at least one solid neutralizing agent. The builder acid is selected from citric acid, tartaric acid, succinic acid, malonic acid, adipic acid, maleic acid, fumaric acid, oxalic acid, gluconic acid, nitrilotriacetic acid, aspartic acid, ethylenediaminetetraacetic acid, aminotrimethylenephosphonic acid, hydroxyethanediphosphonic acid, polyaspartic acids, polyacrylic acids, polymethacrylic acids, or copolymers thereof and has a particle size below 200 μm.

15 Claims, No Drawings

METHOD FOR THE PRODUCTION OF SURFACTANT GRANULATES CONTAINING BUILDERS

CROSS REFERENCE TO RELATED APPLICATIONS

This application is a continuation of PCT/EPO2/14124, filed Dec. 12, 2002, which claims the benefit of DE 101 63 603.2, filed Dec. 21, 2001, the complete disclosures of which are hereby incorporated by reference in their entirety.

FIELD OF THE INVENTION

The present invention relates to a method for producing surfactant granulates containing builders, and to specific surfactant granulates or compounds.

BACKGROUND

Although the economical synthesis of pale-colored anionic surfactants is nowadays definite state of the art, during the production and the processing of such surfactants, problems relating to applications arise. For example, the anionic surfactants are produced in the course of the production method in their acid form and have to be converted to their alkaline metal or alkaline earth metal salts using suitable neutralizing agents.

This neutralization step can be carried out with solutions of alkali metal hydroxides or else with solid alkaline substances, in particular sodium carbonate. In the case of neutralization with aqueous alkalis, the surfactant salts are produced in the form of aqueous preparation forms, it being possible to establish water contents in the range from about 10 to 80% by weight and in particular in the range from about 35 to 60% by weight. Products of this type have a paste-like to cutable nature at room temperature, the flowability and pumpability of such pastes being limited or even lost even in the region of about 50% by weight of active substance, giving rise to considerable problems during the processing of such pastes, in particular during their incorporation into solid mixtures, for example into solid detergents and cleaners. Accordingly, it is an old requirement to be able to make available anionic detergent surfactants in dry, in particular pourable, form. In fact, it is also possible to obtain pourable anionic surfactant powders or granulates, in particular those of fatty alcohol sulfates (FAS) by conventional drying technology. However, there are serious limitations here since the resulting preparations are often hygroscopic, absorb water from the air during storage to form clumps and even in the finished detergent product have a tendency toward clumping.

Comparable or other difficulties arise during the conversion of aqueous, in particular paste-like, preparation forms of numerous other washing- and cleaning-active surfactant compounds to give storage-stable solids. Further examples of anion-active fatty chemical surfactant compounds to be mentioned are the known sulfo fatty acid methyl esters (fatty acid methyl ester sulfonates, MESs), which are prepared by α-sulfonation of the methyl esters of fatty acids of vegetable or animal origin with predominantly 10 to 20 carbon atoms in the fatty acid molecule and subsequent neutralization to give water-soluble mono salts, in particular the corresponding alkali metal salts. As a result of ester cleavage, they produce the corresponding sulfo fatty acids or their disalts which, like mixtures of disalts and sulfo fatty acid methyl ester monosalts, are attributed important properties with regard to washing and cleaning. Finally, however, even drying of an aqueous paste of the alkali metal salts of washing-active soaps and/or ABS pastes can also be accompanied by considerable problems.

An alternative to the spray-drying of surfactant pastes is granulation. The patent literature also contains broad prior art relating to the non-tower production of detergent and cleaners. Many of these processes start from the acid form of the anionic surfactants since this class of surfactant represents the largest fraction of washing-active substances in terms of amount, and the anionic surfactants are produced in the course of their preparation in the form of the free acids, which have to be neutralized to the corresponding salts.

For example, European patent application EP-A-0 678 573 (Procter & Gamble) describes a method for producing pourable surfactant granulates with bulk densities above 600 g/l, in which anionic surfactant acids are reacted with an excess of neutralizing agent to give a paste with at least 40% by weight of surfactant, and this paste is mixed with one or more powder(s), of which at least one must be spray-dried and comprises the anionic polymer and cationic surfactant, where the resulting granulate may be optionally dried. Although this specification reduces the fraction of spray-dried granulates in the detergents and cleaners, it does not avoid spray-drying entirely.

European patent application EP-A-0 438 320 (Unilever) discloses a batch process for producing surfactant granulates with bulk densities above 650 g/l. In this process, a solution of an alkaline inorganic substance in water, with the possible addition of other solids, is admixed with the anionic surfactant acid and granulated with a liquid binder in a high-speed mixer/granulator. Although neutralization and granulation take place in the same apparatus, they are in separate process steps, meaning that the process can only be operated batchwise.

European patent application EP-A-0 402 112 (Procter & Gamble) discloses a continuous neutralization/granulation process for producing FAS and/or ABS granulates from the acid in which the ABS acid is neutralized with at least 62% strength NaOH and then granulated, with the addition of auxiliaries, for example ethoxylated alcohols or alkylphenols or a polyethylene glycol with a molar mass between 4000 and 50 000 which melts above 48.9° C.

European patent application EP-A-0 508 543 (Procter & Gamble) gives a process in which a surfactant acid is neutralized with an excess of alkali to give an at least 40% strength by weight surfactant paste, which is then conditioned and granulated, direct cooling taking place with dry ice or liquid nitrogen.

Dry neutralization processes in which sulfonic acids are neutralized and granulated are disclosed in EP 555 622 (Procter & Gamble). According to the teaching of this specification, the neutralization of the anionic surfactant acids takes place in a high-speed mixer by means of an excess of finely divided neutralizing agent with an average particle size below 5 μm.

A similar process which is also carried out in a high-speed mixer and in which sodium carbonate ground to 2 to 20 μm is used as neutralizing agent is described in WO 98/20104 (Procter & Gamble).

Surfactant mixtures which are subsequently sprayed onto solid absorbers and provide detergent compositions or components therefor are also described in EP 265 203 (Unilever). The liquid surfactant mixtures disclosed in this specification comprise sodium or potassium salts of alkylbenzenesulfonic acids or alkylsulfuric acids in amounts up to 80% by weight, ethoxylated nonionic surfactants in amounts up to 80% by weight, and at most 10% by weight of water.

Similar surfactant mixtures are also disclosed in the earlier EP 211 493 (Unilever). According to the teaching of this specification, the surfactant mixtures to be sprayed on comprise between 40 and 92% by weight of a surfactant mixture, and more than 8 to at most 60% by weight of water. The surfactant mixture consists in turn of at least 50% polyalkoxylated nonionic surfactants and ionic surfactants.

A process for producing a liquid surfactant mixture from the three constituents anionic surfactant, nonionic surfactant and water is described in EP 507 402 (Unilever). The surfactant mixtures disclosed here, which reportedly comprise little water, are produced by bringing together equimolar amounts of neutralizing agent and anionic surfactant acid in the presence of nonionic surfactant.

German laid-open specification DE-A-42 32 874 (Henkel KGaA) discloses a process for producing washing- and cleaning-active anionic surfactant granulates by neutralizing anionic surfactants in their acid form. The neutralizing agents disclosed here are solid, pulverulent substances, in particular sodium carbonate which reacts with the anionic surfactant acids to give anionic surfactant, carbon dioxide and water. The resulting granulates have surfactant contents around 30% by weight and bulk densities of less than 550 g/l.

European laid-open specification EP 642 576 (Henkel KGaA) describes a two-stage granulation in two serially connected mixers/granulators, where, in a first, low-speed granulator, 40–100% by weight, based on the total amount of the constituents used, of the solid and liquid constituents are pregranulated and, in a second, high-speed granulator, the pregranulate, optionally with the remaining constituents, is mixed and converted to a granulate.

European patent specification EP 772 674 (Henkel KGaA) describes a process for producing surfactant granulates by spray-drying, in which anionic surfactant acid(s) and high-concentration alkaline solutions are supplied separately with a gaseous medium and mixed in a multicomponent nozzle, neutralized and spray-dried by spraying into a stream of hot gas. The finely divided surfactant particles obtained in this way are then agglomerated in a mixer to give granulates with bulk densities above 400 g/l.

German laid-open specification DE-A-43 14 885 (Süd-Chemie) discloses a process for producing washing- and cleaning-active anionic surfactant granulates by neutralization of the acid form of anionic surfactants with a basic-acting compound, the hydrolysis-sensitive acid form of an hydrolysis-sensitive anionic surfactant being reacted with the neutralizing agent without the liberation of water. Preference is given to using sodium carbonate as neutralizing agent; it reacts in this process to give sodium hydrogencarbonate.

SUMMARY

The object of the present invention was then to provide a method which allows the production of builder-containing detergents and cleaners without the use, or the reduced use, of spray-drying steps. Furthermore, the aim was to achieve a further cost optimization compared with processes disclosed in the prior art. The process to be provided was to likewise permit the direct and economically attractive processing of the acid forms of detergent raw materials, but largely avoid the disadvantage of the energy-intensive evaporation of water. The bulk densities of the builder- and surfactant-containing granulates to be prepared were to be variable within wide limits, it being a particular aim of the present invention to be able to achieve the low bulk densities of conventional spray-drying products with the help of a non-tower process. The solubilities of the method end products were to be equivalent or superior to the end products of the processes known from the prior art.

It has now been found that readily soluble builder-containing surfactant granulates with varying bulk density and excellent solubility profile can be produced if the anionic surfactant acids are admixed with builder acids in certain amounts prior to the neutralization.

DETAILED DESCRIPTION

The present invention provides, in a first embodiment, a method for the production of surfactant granulates containing builders by neutralizing mixtures of anionic surfactant acids and builder acids with solid neutralizing agents, in which said acids is/are contacted with the solid neutralizing agent(s), where the weight ratio of builder acid(s) to anionic surfactant acid(s) in the acid mixture to be neutralized is 1:500 to 50:1.

According to the invention, anionic surfactant acid(s) and builder acid(s) are mixed together prior to the neutralization, i.e. prior to contact with the solid neutralizing agent(s). This acidic mixture is then neutralized with solid neutralizing agents. The acidic mixture comprises at least about 0.2% by weight and at most about 98% by weight of builder acid(s), corresponding to a mass ratio of builder acids to anionic surfactant acids in the acid mixture of from 1:500 to 50:1. Preferably, builder acids are used in a narrower weight ratio to anionic surfactant acids, it being particularly preferred that the acid mixture comprises more anionic surfactant acids than builder acids. Preferred methods according to the invention are characterized in that the weight ratio of builder acid(s) to anionic surfactant acid(s) in the acid mixture to be neutralized is 1:400 to 1:10, preferably 1:250 to 1:15, particularly preferably 1:100 to 1:20 and in particular 1:75 to 1:25. The acidic mixture thus preferably comprises at least about 0.25% by weight and at most about 90% by weight of builder acid(s), preferably at least about 0.4% by weight and at most about 67% by weight of builder acid(s), particularly preferably at least about 1% by weight and at most about 80% by weight of builder acid(s) and in particular at least about 1.3% by weight and at most about 4% by weight of builder acid(s).

Preferred amounts of builder acid(s) in the acid mixture to be neutralized are, for example, 1.5% by weight, 1.75% by weight, 2% by weight, 2.25% by weight, 2.5% by weight, 2.75% by weight, 3% by weight, 3.25% by weight, 3.5% by weight and 3.75% by weight, in each case based on the mass of the mixture to be neutralized.

The anionic surfactants used in acid form are preferably one or more substances from the group of carboxylic acids, of sulfuric half-esters and of sulfonic acids, preferably from the group of fatty acids, fatty alkylsulfuric acids and alkylarylsulfonic acids. In order to have adequate surface-active properties, said compounds should have relatively long-chain hydrocarbon radicals, i.e. at least 6 atoms in the alkyl or alkenyl radical. The carbon chain distributions of the anionic surfactants are usually in the range from 6 to 40, preferably 8 to 30 and in particular 12 to 22, carbon atoms. Preferred methods according to the invention are characterized in that one or more substances from the group of carboxylic acids, sulfuric half-esters and sulfonic acids, preferably from the group of fatty acids, fatty alkylsulfuric acids and alkylarylsulfonic acids, are used as anionic surfactant in acid form. These are described below.

Carboxylic acids which are used in the form of their alkali metal salts as soaps in detergents and cleaners are obtained industrially for the greatest part from natural fats and oils by hydrolysis. Whereas the alkaline hydrolysis, carried out as early as the previous century, led directly to the alkali metal salts (soaps), nowadays in industry only water is used for the cleavage, which cleaves the fats into glycerol and the free fatty acids. Processes used industrially are, for example, autoclave cleavage or continuous high-pressure cleavage. Carboxylic acids which can be used for the purposes of the present invention as anionic surfactants are, for example, hexanoic acid (caproic acid), heptanoic acid (enanthic acid), octanoic acid (caprylic acid), nonanoic acid (pelargonic acid), decanoic acid (capric acid), undecanoic acid, etc. For the purposes of the present compound, preference is given to the use of fatty acids such as dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), hexacosanoic acid (cerotic acid), triacotanoic acid (melissic acid), and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12,15c-octadecatrienoic acid (linolenic acid). For cost reasons, it is preferred not to use the pure species, but technical-grade mixtures of the individual acids, as are accessible from fat cleavage. Such mixtures are, for example, coconut oil fatty acid (about 6% by weight of $C_8$, 6% by weight of $C_{10}$, 48% by weight of $C_{12}$, 18% by weight of $C_{14}$, 10% by weight of $C_{16}$, 2% by weight of $C_{18}$, 8% by weight of $C_{18'}$, 1% by weight of $C_{18''}$), palm kernel oil fatty acid (about 4% by weight of $C_8$, 5% by weight of $C_{10}$, 50% by weight of $C_{12}$, 15% by weight of $C_{14}$, 7% by weight of $C_{16}$, 2% by weight of $C_{18}$, 15% by weight of $C_{18'}$, 1% by weight of $C_{18''}$), tallow fatty acid (about 3% by weight of $C_{14}$, 26% by weight of $C_{16}$, 2% by weight of $C_{16'}$, 2% by weight of $C_{17}$, 17% by weight of $C_{18}$, 44% by weight of $C_{18'}$, 3% by weight of $C_{18''}$, 1% by weight of $C_{18'''}$), hydrogenated tallow fatty acid (about 2% by weight of $C_{14}$, 28% by weight of $C_{16}$, 2% by weight of $C_{17}$, 63% by weight of $C_{18}$, 1% by weight of $C_{18''}$), technical-grade oleic acid (about 1% by weight of $C_{12}$, 3% by weight of $C_{14}$, 5% by weight of $C_{16}$, 6% by weight of $C_{16'}$, 1% by weight of $C_{17}$, 2% by weight of $C_{18}$, 17% by weight of $C_{18'}$, 10% by weight of $C_{18''}$, 0.5% by weight of $C_{18'''}$), technical-grade palmitic/stearic acid (about 1% by weight of $C_{12}$, 2% by weight of $C_{14}$, 45% by weight of $C_{16}$, 2% by weight of $C_{17}$, 47% by weight of $C_{18}$, 1% by weight of $C_{18'}$), and soybean oil fatty acid (about 2% by weight of $C_{14}$, 15% by weight of $C_{16}$, 5% by weight of $C_{18}$, 25% by weight of $C_{18'}$, 45% by weight of $C_{18''}$, 7% by weight of $C_{18'''}$).

Sulfuric half-esters of longer-chain alcohols are likewise anionic surfactants in their acid form and can be used for the purposes of the method according to the invention. Their alkali metal salts, in particular sodium salts, the fatty alcohol sulfates, are accessible industrially from fatty alcohols, which are reacted with sulfuric acid, chlorosulfonic acid, amidosulfonic acid or sulfur trioxide to give the alkylsulfuric acids in question and are subsequently neutralized. The fatty alcohols here are obtained from the fatty acids or fatty acid mixtures in question by high-pressure hydrogenation of the fatty acid methyl esters. The most important industrial process, in terms of amount, for producing fatty alkylsulfuric acids is the sulfation of the alcohols with $SO_3$/air mixtures in special cascade, falling-film or tube-bundle reactors.

A further class of anionic surfactant acids which can be used according to the invention are the alkyl ether sulfuric acids, whose salts, the alkyl ether sulfates, are characterized by higher solubility in water and lower sensitivity toward water hardness (solubility of the Ca salts). Alkyl ether sulfuric acids are synthesized like the alkylsulfuric acids from fatty alcohols, which are reacted with ethylene oxide to give the corresponding fatty alcohol ethoxylates. Instead of ethylene oxide, it is also possible to use propylene oxide. The subsequent sulfonation with gaseous sulfur trioxide in short-path sulfation reactors produces yields greater than 98% of the corresponding alkyl ether sulfuric acids.

Alkanesulfonic acids and olefinsulfonic acids can also be used as anionic surfactants in acid form for the purposes of the present invention. Alkanesulfonic acids can contain the sulfonic acid group terminally bonded (primary alkanesulfonic acids) or along the carbon chain (secondary alkanesulfonic acids), only the secondary alkanesulfonic acids being of commercial importance. These are prepared by sulfochlorination or sulfoxidation of linear hydrocarbons. During the sulfochlorination in accordance with Reed, n-paraffins are reacted with sulfur dioxide and chlorine with irradiation by UV light to give the corresponding sulfochlorides which, upon hydrolysis with alkalis, directly produce the alkanesulfonates, upon reaction with water the alkanesulfonic acids. Since di- and polysulfochlorides and also chlorinated hydrocarbons can arise as by-products of the free-radical reaction during the sulfochlorination, the reaction is usually carried out only up to degrees of conversion of 30% and then terminated.

Another process for producing alkanesulfonic acids is sulfoxidation, in which n-paraffins are reacted with sulfur dioxide and oxygen under irradiation with UV light. In this free-radical reaction, successive alkylsulfonyl radicals are formed, which further react with oxygen to give the alkylpersulfonyl radicals. The reaction with unreacted paraffin produces an alkyl radical and the alkylpersulfonic acid, which decomposes into an alkylperoxysulfonyl radical and a hydroxyl radical. The reaction of the two radicals with unreacted paraffin produces the alkylsulfonic acids or water, which reacts with alkylpersulfonic acid and sulfur dioxide to give sulfuric acid. In order to keep the yield of the two end products alkylsulfonic acid and sulfuric acid as high as possible and to suppress secondary reactions, this reaction is usually carried out only up to degrees of conversion of 1% and then terminated.

Olefinsulfonates are produced industrially by reacting α-olefins with sulfur trioxide. In this process, zwitterions form as intermediate, which cyclize to give so-called sultones. Under suitable conditions (alkaline or acidic hydrolysis), these sultones react to give hydroxyalkanesulfonic acids or alkenesulfonic acids, both of which can likewise be used as anionic surfactant acids.

Alkylbenzenesulfonates, being high-performance anionic surfactants, have been known since the thirties of this previous century. Then, monochlorination of Kogasin fractions and subsequent Friedel-Crafts alkylation were used to produce alkylbenzenes which were sulfonated with oleum and neutralized with sodium hydroxide solution. At the start of the fifties, for the preparation of alkylbenzenesulfonates, propylene was tetramerized to give branched α-dodecylene, and the product was reacted via a Friedel-Crafts reaction using aluminum trichloride or hydrogen fluoride to give tetrapropylenebenzene, which was subsequently sulfonated and neutralized. This economic possibility for the production of tetrapropylenebenzenesulfonates (TPS) led to the breakthrough for this class of surfactant, which subsequently replaced soaps as the main surfactant in detergents and cleaners.

Due to the inadequate biodegradability of TPS, there was a need to prepare novel alkylbenzenesulfonates which are characterized by improved ecological behavior. These requirements are satisfied by linear alkylbenzenesulfonates, which are nowadays the alkyl-benzenesulfonates produced almost exclusively and are denoted by the abbreviation ABS.

Linear alkylbenzenesulfonates are prepared from linear alkylbenzenes, which in turn are accessible from linear olefins. For this, petroleum fractions are separated industrially into the n-paraffins of the desired purity using molecular sieves and dehydrogenated to give the n-olefins, resulting in both α- and also i-olefins. The resulting olefins are then reacted in the presence of acidic catalysts with benzene to give the alkylbenzenes, the choice of Friedel-Crafts catalyst having an influence on the isomer distribution of the resulting linear alkylbenzenes: when aluminum trichloride is used, the content of the 2-phenyl isomers in the mixture with the 3-, 4-, 5- and other isomers is about 30% by weight; if on the other hand hydrogen fluoride is used as catalyst, the content of 2-phenyl isomer can drop to about 20% by weight. Finally, the sulfonation of the linear alkylbenzenes takes place nowadays industrially with oleum, sulfuric acid or gaseous sulfur trioxide, the latter being by far the most important. For the sulfonation, special film or tube-bundle reactors are used which produce, as product, a 97% strength by weight alkylbenzenesulfonic acid (ABSA), which can be used as anionic surfactant acid for the purposes of the present invention.

Through the choice of the neutralizing agent it is possible to obtain a very wide variety of salts, i.e. alkylbenzenesulfonates, from the ABSA. For reasons of cost, it is preferred to produce and use the alkali metal salts and, among these, preferably the sodium salts of the ABSA. These can be described by the general formula I:

(I)

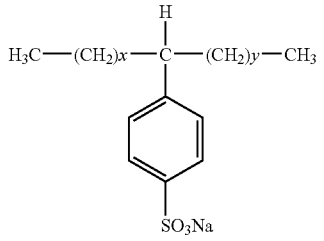

in which the sum of x and y is usually between 5 and 13. Methods according to the invention in which $C_{8-16}$-, preferably $C_{9-13}$-alkylbenzenesulfonic acids are used as anionic surfactant are preferred. For the purposes of the present invention, it is also preferred to use $C_{8-16}$-, preferably $C_{9-13}$-alkylbenzenesulfonic acids which are derived from alkylbenzenes which have a tetralin content below 5% by weight, based on the alkylbenzene. It is further preferred to use alkylbenzenesulfonic acids whose alkylbenzenes have been produced by the HF process, so that the $C_{8-16}$-, preferably $C_{9-13}$-alkylbenzenesulfonic acids used have a content of 2-phenyl isomer below 22% by weight, based on the alkylbenzenesulfonic acid.

The abovementioned anionic surfactants in their acid form can be used on their own or in a mixture with one another in the method according to the invention. It is, however, also possible and preferred for further, preferably acidic, ingredients of detergents and cleaners to be mixed into the anionic surfactant in acid form prior to the addition of the solid neutralizing agent(s), in amounts of from 0.1 to 40% by weight, preferably from 1 to 15% by weight and in particular from 2 to 10% by weight, in each case based on the weight of the mixture containing the anionic surfactant acid.

According to the invention, one or more builder acids are added to the anionic surfactant acids in certain quantitative ratios prior to the neutralization. These acids are mixed with the anionic surfactant acids and neutralized, their salts in the finished granulate or compound having a builder effect, i.e. having a complexing effect on the hardness formers in water. Builder acids which may be used here are the acid forms of the builders and cobuilders customarily admixed in salt form, preference being given to representatives from certain classes of substance, in particular the class of substance of carboxylic acids. Particularly preferred methods according to the invention are characterized in that the builders acids used are one or more substances from the group consisting of citric acid, tartaric acid, succinic acid, malonic acid, adipic acid, maleic acid, fumaric acid, oxalic acid, gluconic acid and/or nitrilotriacetic acid, aspartic acid, ethylenediaminetetraacetic acid, aminotrimethylenephosphonic acid, hydroxyethanediphosphonic acid and/or the groups of polyaspartic acids, polyacrylic and polymethacrylic acids, and copolymers thereof. These substances are described below.

Citric acid (2-hydroxy-1,2,3-propanetricarboxylic acid) has, as monohydrate, a density of 1.542 and a melting point of 100° C., in anhydrous form a density of 1.665 and a melting point of 153° C. Citric acid is very readily soluble in water with an acidic taste and acidic reaction, is likewise readily soluble in alcohol, but is sparingly soluble in ether and insoluble in benzene and chloroform. Upon heating to above 175° C., decomposition takes place with the formation of methylmaleic anhydride. Citric acid is an intermediate of the citric acid cycle is obtained from lemon juice by precipitation with milk of lime as calcium citrate, which is decomposed by sulfuric acid into calcium sulfate and free citric acid. Industrially, more than 90% of citric acid is obtained by aerobic fermentation.

Tartaric acid (2,3-dihydroxybutanedioic acid, 2,3-dihydroxysuccinic acid, tetraric acid, tartar acid) occurs in 3 stereoisomeric forms: the L-(+) form [so-called natural tartaric acid, (2R,3R) form], the D-(−) form [(2S,3S) form] and the meso form [eryuthraric acid]. Tartaric acid is a strong acid, readily soluble in water (the L form more so than the racemate), methanol, ethanol, 1-propanol, glycerol, insoluble in chloroform. The L form occurs in many plants and fruits, in free form and as potassium, calcium or magnesium salt, e.g. in grape juice partially as free tartaric acid, partially as potassium hydrogentartrate, which settles out as tartar together with calcium tartrate after the fermentation of wine. To prepare tartaric acid, tartar is, for example, converted with calcium chloride or calcium hydroxide into calcium tartrate. Sulfuric acid is used to release tartaric acid and gypsum from this, tartaric acid is thus a by-product of wine production. DL- and meso-tartaric acid are obtained in the oxidation of fumaric acid or maleic anhydride with hydrogen peroxide, potassium permanganate, peracids, in the presence of tungstic acid on an industrial scale.

Succinic acid (butanedioic acid), HOOC—$CH_2$—$CH_2$—COOH, has a density of 1.56, a melting point of 185–187° C. and a boiling point of 235° C. to form the anhydride. Succinic acid is very readily soluble in boiling water, readily soluble in alcohols and acetone, but insoluble in benzene, carbon tetrachloride and petroleum ether. The preparation of succinic acid takes place by hydrogenation of maleic acid, oxidation of 1,4-butanediol, oxo synthesis of acetylene and by fermentation from glucose.

Malonic acid (propanedioic acid), HOOC—$CH_2$—COOH, C3H4O4, has a density of 1.619, a melting point of 135° C., acetic acid forms somewhat above this temperature with the elimination of carbon dioxide. Malonic acid is very readily soluble in water and pyridine, soluble in alcohol and ether, insoluble in benzene; in aqueous solution, it decomposes above about 70° C. to give acetic acid and carbon dioxide. Malonic acid is prepared, for example, by reacting chloroacetic acid with NaCN and subsequent hydrolysis of the resulting cyanoacetic acid.

Adipic acid (hexanedioic acid), HOOC—$(CH_2)_4$—COOH, has a melting point of 153° C. and a boiling point of 265° C. (at 133 hPa). It is not very soluble in water. Adipic acid is preferably obtained industrially by the oxidative cleavage of cyclohexane. Adipic acid is prepared here in two stages via the intermediate cyclohexanol/cyclohexanone.

Maleic acid [(Z)-2-butenedioic acid] has a density of 1.590, a melting point of 130–131° C. (from alcohol and benzene), or of 138–139° C. (from water), is readily soluble in water and alcohol, less readily soluble in acetone, ether and glacial acetic acid, virtually insoluble in benzene. Maleic acid is stereoisomeric with fumaric acid, into which it can be rearranged thermally or catalytically. In contrast to fumaric acid, it is not a naturally occurring compound and is generally prepared by adding water onto maleic anhydride.

Fumaric acid [(E)- or trans-butenedioic acid, has a density of 1.625 and is moderately soluble in boiling water and alcohol, barely soluble in most organic solvents. Fumaric acid is a type of fruit acid and occurs in a number of plants, e.g. in common fumitory (Fumaric officinalis), in Icelandic moss, and in fungi and lichens. In the citric acid cycle, it arises as intermediate during the dehydrogenation of succinic acid. Fumaric acid is stereoisomeric with maleic acid, from which it can be prepared by isomerization; industrial preparation also takes place by fermentation from sugar or starch.

Oxalic acid (ethanedioic acid, sorrel acid), HOOC—COOH, has a density of 1.653, a melting point of 101.5° C. and a boiling point of 150° C. Oxalic acid dissolves very readily in water (120 g/l) and in ethanol, but less so in ether and not at all in benzene, chloroform, petroleum ether. Oxalic acid is one of the most widespread plant acids and is found primarily in common wood sorrel as the acidic potassium salt, in sorrel and rhubarb. Oxalic acid was prepared earlier by acidic hydrolysis of dicyanogen, nowadays by oxidation of carbohydrates, glycols, olefins, acetylenes or acetaldehyde with concentrated nitric acid in the presence of catalysts or by alkali melts of sodium formate.

Nitrilotriacetic acid (abbreviation NTA), $N(CH_2$—$COOH)_3$, has a melting point of 242° C. (with decomposition), is barely soluble in water, and readily soluble in alcohol. The sodium salts of NTA are prepared by cyanomethylation of ammonia with formaldehyde and sodium cyanide and subsequent hydrolysis of the intermediate tris (cyanomethyl)amine (alkaline process), which can also be obtained by reacting hexamethylenetriamine with hydrogen cyanide in sulfuric acid (acidic process). The sodium salts of NTA are readily biodegradable complexing agents (chelating agents) from the substance class of aminocarboxylates, which are used in some countries, such as Canada and Switzerland, as a constituent of builder systems in detergents. In the Federal Republic of Germany and other European countries, NTA-containing detergents are not marketable due to the differences to the difficultly biodegradable complexing agent EDTA (see below) which, whilst clearly demonstrable, cannot be conveyed to the general public.

Aspartic acid (2-aminosuccinic acid, abbreviation of the L form is Asp or D), has a density of 1.66, melts at 270° C. (with decomposition) and is sparingly soluble in water, and insoluble in alcohols. The nonessential amino acid L-aspartic acid is found, for example, in zein in an amount of 1.8% by weight, in the casein of cows' milk in an amount of 1.4% by weight, in equine hemoglobin in an amount of 4.4% by weight, in wool keratin in an amount of 5–10%. It is accessible synthetically from maleic acid or fumaric acid and ammonia under pressure and by subsequent racemate resolution or—on a scale of about 1000 t/a—enzymatically with aspartase (L-aspartate ammonia lyase, EC 4.3.1.1).

Polyaspartic acids are polypeptides of aspartic acid. Polyaspartic acid sequences are found naturally in mussel or snail shells, where they regulate shell growth. The industrial product is prepared from maleic anhydride by ammonolysis and polymerization with subsequent basic hydrolysis (Bayer) and contains both $\alpha$ and also $\beta$ bonds. Polyaspartic acids are excellent dispersants for solids and particularly effective stabilizers for hardness formers in water. As an excellent sequestering agent, they are suitable for removing and preventing encrustations. They are already used in ecologically high-value detergents.

Ethylenediaminetetraacetic acid (ethylenedinitrilotetraacetic acid, EDTA), decomposes above 150° C. with loss of $CO_2$ and is sparingly soluble in water. Ethylenediaminetetraacetic acid and its alkali metal and alkaline earth metal salts (the so-called edetates) react—similarly to ethylenediamine—with many metal ions to form nonionized chelates, which are used in order to dissolve or eliminate troublesome metal salt deposits; ethylenediaminetetraacetic acid is prepared from ethylenediamine and chloroacetic acid or by acidic or alkaline cyanomethylation of ethylenediamine with formaldehyde and hydrocyanic acid.

A further substance class of the builder acids are the phosphonic acids. In particular, these are hydroxyalkane- or aminoalkanephosphonic acids. Among the hydroxyalkanephosphonic acids, 1-hydroxyethane-1,1-diphosphonic acid (HEDP) is of particular importance. It is preferably neutralized to give the sodium salt, the disodium salt being neutral and the tetrasodium salt being alkaline (pH 9).

Further suitable builder acids are, for example, the polymeric polycarboxylic acids, these are, for example, the polyacrylic acid or the polymethacrylic acid, for example those with a relative molecular mass of from 500 to 70 000 g/mol.

For the purposes of this specification, the molar masses quoted for polymeric polycarboxylic acids are weight-average molar masses $M_w$ of the particular acid form, which have been determined in principle by means of gel permeation chromatography (GPC), using a UV detector. The measurement was made against an external polyacrylic acid standard which, due to its structural similarity to the investigated polymers, produces realistic molecular weight values. This data differs significantly from the molecular weight data in which polystyrenesulfonic acids are used as standard. The molar masses measured against polystyrenesulfonic acids are generally considerably higher than the molar masses quoted in this specification.

Suitable polymers are, in particular, polyacrylic acids which preferably have a molecular mass of from 2000 to 20 000 g/mol. Due to the superior solubility of their neutralized salts, the short-chain polyacrylic acids, which have molar masses of from 2000 to 10 000 g/mol and particularly preferably from 3000 to 5000 g/mol, may in turn be preferred from this group.

Also suitable are copolymeric polycarboxylic acids, in particular those of acrylic acid with methacrylic acid and of acrylic acid or methacrylic acid with maleic acid. Copolymers of acrylic acid with maleic acid which contain 50 to 90% by weight of acrylic acid and 50 to 10% by weight of maleic acid have proven to be particularly suitable. Their relative molecular mass, based on free acids, is generally 2000 to 70 000 g/mol, preferably 20 000 to 50 000 g/mol and in particular 30 000 to 40 000 g/mol.

Further suitable builder acids are ethylenediaminetetra (methylenephosphonic acid) (EDTMP), diethylenetriaminepenta(methylenephosphonic acid) (DTPMP), 1-hydroxyethane-1,1-diphosphonic acid (HEDP), 2-phosphonobutane-1,2,4-tricarboxylic acid (PBTC), hexamethylenediaminetetra(methylenephosphonic acid) (HDTMP), diethylenetriaminepentaacetic acid (DTPA), propylenediaminetetraacetic acid (PDTA), methyl-glycinediacetic acid (MGDA), iminodisuccinic acid (IDS), ethylenediamine-N,N'-disuccinic acid (Octaquest E).

It is, however, also possible to mix acid-stable ingredients with the anionic surfactant acid. Suitable here are, for example, so-called small components, which would otherwise have to be added in lengthy further steps, thus, for example, optical brighteners, dyes etc., it being necessary to check the acid stability in individual cases.

Nonionic surfactants are preferably added to the anionic surfactant in acid form. This addition may improve the physical properties of the mixture containing the anionic surfactant acid and render superfluous a subsequent incorporation of nonionic surfactants into the surfactant granulate or the entire detergent and cleaner.

The various representatives from the group of nonionic surfactants are described below. Methods preferred according to the invention are characterized in that further ingredients of detergents or cleaners, preferably nonionic surfactant(s), preferably in amounts of from 5 to 90% by weight, particularly preferably from 25 to 80% by weight and in particular from 30 to 70% by weight, in each case based on the weight of the mixture to be added to the neutralizing agent are added to the mixture of builder acid(s) and anionic surfactant acid(s) prior to the neutralization.

It is particularly preferred to suspend the abovementioned builder acids in solid form in the anionic surfactant acid(s), where the builder acids preferably have a certain particle size. Preference is given here to methods according to the invention in which the builder acid(s) is/are suspended in the anionic surfactant acid(s), and the builder acid(s) have a particle size below 200 μm, preferably below 150 μm and in particular below 100 μm.

Irrespective of whether a single anionic surfactant acid or two or more anionic surfactant acids—optionally in a mixture with further acidic or acid-stable ingredients—is or are added to the solid neutralizing agent or the mixture of two or more solids, it is preferred that the temperature of the mixture to be added is as low as possible. Preference is given here to methods according to the invention in which the anionic surfactant acids, when added to the solid bed, have a temperature of from 15 to 70° C., preferably from 20 to 60° C., particularly preferably from 25 to 55° C. and in particular from 40 to 50° C. Analogously, it is also preferred that the solid bed has the lowest possible temperature. Preference is given here to temperatures between 0 and 30° C., preferably between 5 and 25° C. and in particular between 10 and 20° C.

For example, the method according to the invention can take place in all devices in which neutralization can be carried out with simultaneous granulation. Examples thereof are mixers and granulators, in particular granulators of the Turbo dryer® type (device from Vomm, Italy).

When choosing suitable machines and process parameters for the method according to the invention, the person skilled in the art may refer to machines and apparatuses known in the literature, and also processing operations, as are described, for example, in W. Pietsch, "*Size Enlargement by Agglomeration*", Verlag Wiley, 1991, and the literature cited therein. The statements below are only a small section of possibilities which the person skilled in the art has for carrying out the neutralization reaction between anionic surfactant acid(s) and sodium carbonate.

For example, it is preferred to carry out the reaction in one or more mixer(s). As already mentioned, the preparation of mixer granulates can be carried out in a large number of customary mixing or granulation devices. Mixers suitable for carrying out the method according to the invention are, for example, Eirich® mixers of the R or RV series (trade name of Maschinenfabrik Gustav Eirich, Hardheim), the Schugi® Flexomix, the Fukae® FS-G mixer (trade name of Fukae Powtech, Kogyo Co., Japan), the Lödige® FM, KM and CB mixer (trade name of Lödige Maschinenbau GmbH, Paderborn) or the Drais® T or K-T series (trade name of Drais-Werke GmbH, Mannheim). Some preferred embodiments of the method according to the invention for implementation in mixers are described below.

For example, it is possible and preferred to carry out the method according to the invention in a low-speed mixer/granulator at peripheral speeds of the tools of from 2 m/s to 7 m/s. Alternatively, in preferred method variants, the method can be carried out in a high-speed mixer/granulator at peripheral speeds of from 8 m/s to 35 m/s.

While the two above-described method variants each describe the use of a mixer, it is also possible in accordance with the invention to combine two mixers with one another. Thus, for example, preference is given to processes in which a liquid granulation auxiliary (in the present case the anionic surfactant acid(s) with optionally present additives) is added in a first, low-speed mixer/granulator to a mobile solid bed (in the method according to the invention sodium carbonate with optional further ingredients), where 40 to 100% by weight, based on the total amount of the constituents used, of the solid and liquid constituents are pregranulated and, in a second, high-speed mixer/granulator, the pregranulate from the first method stage is optionally mixed with the remaining solid and/or liquid constituents and converted to a granulate. In this method variant, a granulation auxiliary is added in the first mixer/granulator to a solid bed and the mixture is pregranulated. The composition of the granulation auxiliary and of the solid bed initially introduced in the first mixer are chosen here so that 40 to 100% by weight, preferably 50 to 90% by weight and in particular 60 to 80% by weight, of the solid and liquid constituents, based on the total amount of the constituents used, are in the "pregranulate". This "pregranulate" is then mixed in the second mixer with further solids and, with the addition of further liquid components, granulated to give the finished surfactant granulate.

The order of low-speed and high-speed mixers specified can also be reversed according to the invention, thus resulting in a method according to the invention in which the liquid granulation auxiliary is placed in a first, high-speed mixer/granulator on a mobile solid bed, where 40 to 100% by weight, based on the total amount of the constituents used, of the solid and liquid constituents are pregranulated and, in a second, low-speed mixer/granulator, the pregranulate from the first method stage is optionally mixed with the remaining solid and/or liquid constituents and converted to a granulate.

All of the above-described variant embodiments of the method according to the invention can be carried out batchwise or continuously. In the above-described variant embodiments of the method according to the invention, use is made in some cases of high-speed mixers/granulators. For the purposes of the present invention, it is particularly preferred for the high-speed mixer used to be a mixer which has both a mixing device and also reducing device, the mixing shaft being operated at peripheral speeds of from 50 to 150 revolutions/minute, preferably from 60 to 80 revolutions/minute, and the shaft of the reducing device being operated at peripheral speeds of from 500 to 5000 revolutions/minute, preferably from 1000 to 3000 revolutions/minute.

Preferred granulation processes for producing mixer granulates are carried out in mixer granulators in which some parts of the mixer or the entire mixer are designed to be coolable in order to be able to dissipate, where appropriate, the heat released during the neutralization reaction (in particular in the case of high throughputs and when using undiluted raw materials).

In the granulation processes described above, the mixture of anionic surfactant acid(s) and builder acid(s) can be fed to the solid bed by pouring in in a stream of greater or less force, which is less preferable for reasons of reaction control and homogeneity of the distribution of the anionic surfactant acid and builder acid within the neutralizing agent. By spraying or atomizing, the mixture can also be introduced to the solid bed in the form of droplets or a fine mist. A further alternative consists in preparing an acidic foam which is added to the neutralizing agent (or to which the neutralizing agent is added). Such a method according to the invention is preferred and characterized in that the mixture of builder acid(s) and anionic surfactant acid(s) is supplied with a gaseous medium and foamed by the gaseous medium and the resulting foam is then added to a solid bed initially introduced into a mixer.

The term "foam" used for the purposes of the present invention characterizes structures of gas-filled, spherical or polyhedral cells which are delimited by liquid, semiliquid or high-viscosity cell ribs.

If the volume concentration of the gas forming the foam is less than 74% in homodisperse distribution, then the gas bubbles are spherical due to the surface-reducing effect of the interfacial tension. Above the limit of the tightest sphere packing, the bubbles are deformed to polyhedral lamellae, which are limited by skins about 4–600 nm in thickness. The cell ribs, connected via so-called points of intersection, form a continuous framework. The foam lamellae stretch between the cell ribs (closed-cell foam). If the foam lamellae are destroyed or if they flow back into the cell rib at the end of foam formation, an open-cell foam is obtained. Foams are thermodynamically unstable since surface energy can be obtained as a result of a reduction in the surface area. The stability and thus the existence of the foams according to the invention is thus dependent on the extent to which it is possible to prevent their self-destruction.

To generate the foams, the gaseous medium is bubbled into said liquids, or foaming is achieved by vigorous beating, shaking, spraying or stirring of the liquid in the gas atmosphere in question. Due to foaming which is easier and can be better controlled and carried out, in the context of the present invention foam generation by blowing in the gaseous medium ("gassing") is much preferred over the other variants. Depending on the desired method variant, gassing takes place here continuously or discontinuously via perforated plates, sintering disks, sieve inserts, Venturi jets, inline mixer, homogenizers or other customary systems.

The gaseous medium which may be used for the foaming is any gases or gas mixtures. Examples of gases used in the art are nitrogen, oxygen, inert gases and inert gas mixtures, such as, for example, helium, neon, argon and mixtures thereof, carbon dioxide etc. For reasons of cost, the method according to the invention is preferably carried out with air as the gaseous medium. If the components to be foamed are oxidation-stable, the gaseous medium may also consist entirely or in part of ozone, as a result of which oxidatively destructible impurities or discolorations in the surfactant-containing flowable components to be foamed can be eliminated or microbial attack of these components can be prevented.

The mixture of anionic surfactant acid(s) and builder acid(s) is preferably foamed by using the gaseous medium in each case in amounts of at least 20% by volume, based on the amount of liquid to be foamed.

Thus, if, for example, a liter of the anionic surfactant acid(s)/builder acid(s) mixture is to be foamed, at least 200 ml of gaseous medium are preferably used for the foaming. In preferred methods, the amount of gaseous medium is significantly more than this value, meaning that preference is given to methods in which the amount of gas used for the foaming is one to three hundred times, preferably five to two hundred times and in particular ten to one hundred times, the volume of the amount of mixture of builder acid(s) and anionic surfactant acid(s) to be foamed, and, where appropriate, further optional ingredients. As already mentioned above, the gaseous medium used here is preferably air. It is, however, also possible to use other gases or gas mixtures for the foaming. For example, it may be preferred to pass pure oxygen or the air to be used for the foaming over an ozonizator before the gas is used for the foaming. In this way it is possible to produce gas mixtures which comprise, for example, 0.1 to 4% by weight of ozone. The ozone content of the foaming gas then leads to the oxidative destruction of undesired constituents in the liquids to be foamed. In the case of partially discolored anionic surfactant acids in particular, the admixing of ozone can achieve significant lightening.

Preferred methods are characterized in that the gaseous medium used is air.

The acidic foam which is used as granulation auxiliary can be characterized by further physical parameters. Thus, for example, methods are preferred in which the acidic foam has a density of at most 0.80 $gcm^{-3}$, preferably from 0.10 to 0.60 $gcm^{-3}$ and in particular from 0.30 to 0.55 $gcm^{-3}$. It is further preferred that the foam has average pore sizes below 10 mm, preferably below 5 mm and in particular below 2 mm. The average pore size is calculated here from the sum of all pore sizes (pore diameter), which is divided by the number of pores and can be determined, for example, by photographic methods.

The specified physical parameters of temperature, density and average pore size characterize the acidic foam at the time it comes into being. Preferably, the process control is chosen such that the acidic foam satisfies said criteria also when it is added to the mixer.

In this connection, process controls are possible in which the foam satisfies only one or two of the specified criteria when it is added to the mixer, but preferably both the temperature and also the density and the pore size are within the specified ranges when the foam passes to the mixer.

Irrespective of whether the acidic mixture of surfactant acid(s) and builder acid(s) is added in the form of a liquid, in the form of fine droplets or in the form of a foam to the solid bed, it is further preferred when the neutralizing agent used for the acids is sodium carbonate and the reaction is carried out such that this reacts to give sodium hydrogencarbonate. In this connection, the amounts of anionic surfactant acid(s), builder acid(s) and sodium carbonate are to be matched to one another such that a certain carbonate/hydrogencarbonate ratio is kept within the product.

Preferred methods according to the invention are characterized in that the solid neutralizing agents comprise sodium carbonate which reacts at least proportionally to give sodium hydrogencarbonat; where the ratio of the weight fractions of sodium carbonate to sodium hydrogencarbonate in the method end products is preferably 2:1 or more, where the ranges from 50:1 to 2:1, preferably from 40:1 to 2.1:1, particularly preferably from 35:1 to 2.2:1 and in particular from 30:1 to 2.25:1, are particularly preferred.

In this method variant, the reaction between anionic surfactant acid(s) and sodium carbonate is carried out such that the reaction $$Na_2CO_3+2\text{ anionic surfactant-H}\rightarrow 2\text{ anionic surfactant-Na}+CO_2+H_2O$$

is largely suppressed and, in its place, the reaction $$Na_2CO_3+\text{anionic surfactant-H}\rightarrow\text{anionic surfactant-Na}+NaHCO_3$$

arises. The sodium carbonate here is used in excess, meaning that unreacted sodium carbonate remains in the product, while sodium hydrogencarbonate is additionally formed during the reaction. The amount of sodium carbonate in the composition (based on the composition, without taking into consideration any contents of water of hydration which may be present), is placed in relation to the amount of sodium hydrogencarbonate in the composition (based on the composition, without taking into consideration any contents of water of hydration which may be present) and must be 5:1 to 2:1 for this preferred variant. In other words, preferably 2 to 5 grams of $Na_2CO_3$ are present per gram of the $NaHCO_3$ present in the compositions.

In other words again "at least proportionally" means that a certain amount of sodium carbonate must react to give sodium hydrogencarbonate (otherwise the definition of an $Na_2CO_3/NaHCO_3$ ratio would be nonsensical), but on the other hand also that, for the same reasons, unreacted sodium carbonate is also present in the product. At the same time, the fraction of sodium carbonate which does react, but does not form sodium hydrogencarbonate in the reaction should be as low as possible. It is preferred here that at least 70%, preferably at least 80%, particularly preferably at least 90% and in particular the total amount of reacting sodium carbonate is converted to sodium hydrogencarbonate. The fraction of reacting sodium carbonate can be determined here by stoichiometric calculation via the amount of anionic surfactant acid used. Alternatively, the fraction of "falsely" reacting sodium carbonate can be measured from the formation of carbon dioxide and its quantitative determination.

In preferred methods, the water content of the method end products, determined by drying loss at 120° C., is <15% by weight, preferably <10% by weight, particularly preferably <5% by weight and in particular <2.5% by weight. In general, it is preferred to carry out the process with little water in order to ensure the desired reaction to sodium hydrogencarbonate. The raw materials used should therefore as far as possible be dry, dried or water-lean. In the case of the anionic surfactant acids, preference is given according to the invention to choosing the highest possible concentrations, provided technical process control (agitation of the anionic surfactant acid and application to the sodium carbonate) is ensured without any problems.

A further way of favoring the formation of sodium hydrogencarbonate and of avoiding the formation of carbon dioxide and water consists in maintaining the lowest possible temperatures. This can be achieved, for example, through cooling, but also through suitable process control or the matching of the amounts of reactants to one another. In this connection, preference is given to methods according to the invention in which the temperature during the process is maintained below 100° C., preferably below 80° C., particularly preferably below 60° C. and in particular below 50° C.

Methods preferred according to the invention are characterized in that the reactants are added in amounts relative to one another such that the ratio of the fractions by weight of sodium carbonate to sodium hydrogencarbonate in the method end products is 2:1 or more. Preferably, this weight ratio is within narrower limits, meaning that preferred methods are characterized in that the weight ratio of sodium carbonate to sodium hydrogencarbonate in the method end products is 50:1 to 2:1, preferably 40:1 to 2.1:1, particularly preferably 35:1 to 2.2:1 and in particular 30:1 to 2.25:1. Very particularly preferred method end products of the method according to the invention are the compositions according to the invention described above. In other words, particular preference is given to methods according to the invention which are characterized in that the weight ratio of sodium carbonate to sodium hydrogencarbonate in the method end products is 5:1 to 2:1, preferably 4.5:1 to 2: 1, particularly preferably 4:1 to 2.1:1, further preferably 3.5:1 to 2.2:1 and in particular 3.25:1 to 2.25:1.

In particular, preference is given here to methods according to the invention in which the content of sodium hydrogencarbonate in the method end products is 0.5 to 20% by weight, preferably 1 to 15% by weight, particularly preferably 2.5 to 12.5% by weight and in particular 3 to 10% by weight, in each case based on the weight of the method end products.

The method according to the invention is based on the reaction of anionic surfactant acids and builder acids with solid neutralizing agents. In the simplest case, merely anionic surfactant acid, builder acid and sodium carbonate are reacted with one another. However, further substances may also be present in the reaction mixture, which may or may not be involved in the reaction. These reactive or inert substances may be added either to the sodium carbonate or to the anionic surfactant acid(s); alternatively, both reactants can also comprise further reactive or inert ingredients.

For the purposes of the present invention, it is preferred to add further ingredients, in particular further preferably solid neutralizing agents and/or carrier materials, to the sodium carbonate. This mixture forms the solid bed onto which the anionic surfactant acid(s)—optionally in a mixture with further substances—is/are placed. Thus, further neutralizing agents may, for example, be added to the sodium carbonate, preference being given to solid neutralizing agents. Aqueous solutions of neutralizing agents (in particular lyes) can likewise be applied to the sodium carbonate provided the total water balance in the method (the water content of the method end products) is not stretched beyond said limits. It is therefore preferred to use water-lean or even water-free raw materials. Particular preference is given to methods according to the invention in which the solid neutralizing agents additionally comprise one or more substances from the group consisting of sodium hydroxide, sodium sesquicarbonate, potassium hydroxide and/or potassium carbonate.

As an alternative to, or in addition to the addition of further solid neutralizing agents, carrier substances which do not participate in the reaction can also be added to the sodium carbonate. These should have adequate stability to the added acids in order to avoid local decomposition and thus undesired discoloration or other burdening of the product. In this connection, preference is given to methods in which the solid bed comprises further solids from the groups of silicates, aluminum silicates, sulfates, citrates and/or phosphates.

Irrespective of whether a single anionic surfactant acid or a plurality of anionic surfactant acids—and one builder acid or a plurality of builder acids—is or are placed on the solid neutralizing agent or the mixture of two or more solids, it is preferred that the temperature of the mixture to be placed on is as low as possible. Preference is given here to methods according to the invention in which the anionic surfactant acids have a temperature of from 15 to 70° C., preferably from 20 to 60° C., particularly preferably from 25 to 55° C and in particular from 40 to 50° C., when added to the solid bed. Analogously, it is also preferred that the solid bed has the lowest possible temperature. Preference is given here to temperatures between 0 and 30° C., preferably between 5 and 25° C. and in particular between 10 and 20° C. Overall, preference is given to methods in which the temperature during the process is kept below 100° C., preferably below 80° C., particularly preferably below 60° C. and in particular below 50° C.

With regard to the amounts of neutralizing agent and the quantitative ratios of acids/neutralizing agents, preference is given to methods according to the invention in which the content of sodium hydrogencarbonate in the method end products is 0.5 to 40% by weight, preferably 3 to 30% by weight, particularly preferably 5 to 25% by weight and in particular 10 to 20% by weight, in each case based on the weight of the method end products.

As already mentioned, the method according to invention can take place in all devices in which neutralization can be carried out with simultaneous granulation. Examples thereof are mixers and granulators, in particular granulators of the Turbo dryer® type (equipment from Vomm, Italy).

When selecting the suitable machines and process parameters for the method according to the invention, the person skilled in the art may have recourse to literature-known machines and apparatuses, and processing operations as are described, for example, in W. Pietsch, "*Size Enlargement by Agglomeration*", Verlag Wiley, 1991, and the literature cited therein. The statements which follow represent only a small fraction of the ways which the person skilled in the art has to carry out the neutralization reaction between anionic surfactant acid(s) and sodium carbonate.

As an alternative to using mixer granulators, the method according to the invention can also be carried out in a fluidized bed. In a preferred embodiment, the invention envisages that the method according to the invention is carried out in a batchwise or continuously running fluidized bed. It is particularly preferred to carry out the process continuously in the fluidized bed. In this process, the liquid anionic surfactants in their acid form and/or the various liquid components can be introduced into the fluidized bed simultaneously or one after the other via one nozzle, for example via one nozzle with several openings, or via two or more nozzles. The nozzle or the nozzles and the spray direction of the products to be sprayed can be arranged as desired. The solid carriers, which represent the neutralizing agent and optionally further ingredients, can be introduced in finely divided form simultaneously via one or more lines (continuous process) or successively (batch process), preferably pneumatically via blowing lines, the finely divided neutralizing agent being introduced in the batch process as the first solid.

Preferably used fluidized-bed apparatuses have base plates with dimensions of at least 0.4 m. In particular, preference is given to fluidized-bed apparatuses which have a base plate with a diameter between 0.4 and 5 m, for example 1.2 m or 2.5 m. Also suitable, however, are fluidized-bed apparatuses which have a base plate with a diameter larger than 5 m. The base plate used is preferably a perforated base plate or a Conidur plate (commercial product from Hein & Lehmann, Federal Republic of Germany). The method according to the invention is preferably carried out at fluidized-air velocities between 1 and 8 m/s and in particular between 1.5 and 5.5 m/s, for example up to 3.5 m/s. The granulates are discharged from the fluidized bed advantageously via a size classification of the granulates. This classification may take place, for example, by means of a sieve device, or by means of a countercurrent stream of air (sifter air), which is regulated so that only particles above a certain particle size are removed from the fluidized bed and smaller particles are retained in the fluidized bed. In a preferred embodiment, the incoming air is composed of the preferably unheated sifter air and of the base air, which is preferably heated only slightly, if at all. The base air temperature here is preferably between 10 and 70° C., preferably between 15 and 60° C., particularly preferably between 18 and 50° C. Temperatures between 20 and 40° C. are particularly advantageous here. The fluidized air generally cools as a result of heat losses and possibly as a result of the heat of vaporization of the constituents. This heat loss can, however, be balanced or even exceeded by the heat of neutralization in the method according to the invention. In this connection, it is even possible that the air exit temperature exceeds the temperature of the fluidized air approximately 5 cm above the base plate. In a particularly preferred embodiment, the temperature of the fluidized air about 5 cm above the base plate is 30 to 100° C., preferably 35 to 80° C. and in particular 40 to 70° C. The air exit temperature is preferably between 20 and 100° C., in particular below 70° C. and particularly advantageously between 25 and 50° C. In the preferably carried out process in the fluidized bed, it is necessary that, at the start of the process, a starting mass is present which serves as initial carrier for the sprayed-in anionic surfactants in their acid form. Besides the neutralizing agent sodium carbonate, suitable starting masses, for example, are also ingredients of detergents and cleaners, in particular those which can also be used as solids in the method according to the invention and which have a particle size distribution which corresponds approximately to the particle size distribution of the finished granulates. In particular, however, it is preferred to use sodium carbonate as starting mass.

In summary, preference is given to methods according to the invention in which the process is carried out in a fluidized bed and the incoming air temperature is 10 to 70° C., preferably 15 to 60° C., particularly preferably 18 to 50° C. and in particular 20 to 40° C.

Alternatively, mixer granulation and fluidized-bed processes can also be combined with one another. For example, the reactants can be reacted together in a mixer and the resulting neutralisate be passed to a fluidized bed apparatus to carry out an "after-ripening". Preference is given here to methods according to the invention which are characterized in that the process is carried out in a mixer, and an after-ripening of the product then takes place in a fluidized bed with an incoming air temperature of from 10 to 70° C., preferably from 15 to 60° C., particularly preferably from 18 to 50° C. and in particular from 20 to 40° C.

The surfactant granulates obtained by the method according to the invention have, in preferred processes, a bulk density of from 300 to 1000 g/l, preferably from 350 to 800 g/l, particularly preferably from 400 to 700 g/l and in particular from 400 to 500 g/l and are dust-free, i.e. they comprise in particular no particles with a particle size below 50 μm. Otherwise, the particle size distribution of the granulates corresponds to the customary particle size distribution of a detergent and cleaner of the prior art. In particular, the granulates have a particle size distribution in which at most 5% by weight, with particular preference at most 3% by weight, of the particles have a diameter below 0.1 mm, in particular below 0.2 mm. The particle size distribution here can be influenced by the nozzle positioning in the fluidized-bed plant. The granulates are characterized by their pale color and by their flowability. A further measure to prevent the granulates prepared according to the invention from sticking together is not required. If desired, however, a process step may be added subsequently where the granulates are powdered with finely divided materials, for example with zeolite NaA, soda, in a known manner for the purpose of further increasing the bulk density. This powdering can be carried out, for example, during a rounding step. Preferred granulates however, already have such a regular, in particular approximately spherical, structure that a rounding step is generally not necessary and is therefore also not preferred.

The method end products of the method according to the invention can be added directly to detergents or cleaners, they can also be packaged directly as detergents or cleaners for certain applications and be sold.

Besides being mixed with further constituents, such as bleaches, bleach activators, etc., the method end products of the method according to the invention can, however, also serve as a basis for further improved compounds. For example, it is, in particular, possible and preferred that the method end products of the neutralization process—optionally after mixing with further solids—are granulated with the addition of liquid active substances.

This granulation can in turn take place in a very wide range of apparatuses, preference being given for this after-treatment step to mixer granulators. Preference is given here to methods according to the invention in which the addition of liquid active substances takes place shortly before or during after-ripening. This can take place in a mixer with preferably short residence times of from 0.1 to 5 seconds or else in a fluidized bed. Prior complete neutralization is preferred, but is not necessarily required.

Liquid active substances for the subsequent granulation of the method end products of the method according to the invention which may be used are the granulation liquids known to the person skilled in the art, thus, in particular, water or aqueous solutions of salts, waterglass, alkyl polyglycosides, carbohydrates (mono-, oligo- and polysaccharides), synthetic polymers (PEG, PVAL, polycarboxylates), biopolymers, etc. Also possible are mixtures of nonionic surfactants with water, silicone oil and water, supersaturated solvents or surfactant/air mixtures. The water-lean or water-free granulation liquids used are, for example, soaps, nonionic surfactant/polymer solutions, nonionic surfactant/pigment mixtures, melts, mono-, di-, trihydric alcohols, acetone, carbon tetrachloride, solid-containing melts, anhydrously swollen polymers (water-containing organic solvents with swollen polymer) or gas-containing melts.

Particular preference is given to methods according to the invention in which the liquid active substances used are aqueous solutions of silicates and/or polymers, preferably aqueous solutions of waterglasses and/or (meth)acrylic acid polymers and/or copolymers.

These substances are described in detail below. Following the above-described granulation as after-treatment of the method end products of the method according to the invention, the granulates can be dried and/or supplied with further substances. In this connection preference is given in particular to method variants in which the method end products of the granulation process are agglomerated in a fluidized bed and optionally dried.

Method end products of the method according to the invention after-treated in this way have a high absorption capacity for liquid substances, in particular for nonionic surfactants without losing their excellent solubility. A further preferred variant of the method according to the invention therefore envisages that the granulates discharged from the fluidized bed are supplied with further substances, in particular nonionic surfactants.

The nonionic surfactants used here are preferably alkoxylated, advantageously ethoxylated, in particular primary alcohols having preferably 8 to 18 carbon atoms and on average 1 to 12 mol of ethylene oxide (EO) per mole of alcohol, in which the alcohol radical may be linear or preferably methyl-branched in the 2 position and/or can contain linear and methyl-branched radicals in a mixture, as are usually present in oxo alcohol radicals. In particular, however, preference is given to alcohol ethoxylates with linear radicals from alcohols of natural origin having 12 to 18 carbon atoms, e.g. from coconut, palm, tallow fatty or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures thereof, such as mixtures of $C_{12-14}$-alcohol with 3 EO and $C_{12-18}$-alcohol with 5 EO. The given degrees of ethoxylation represent statistical average values which may be an integer or a fraction for a specific product. Preferred alcohol ethoxylates have a narrowed homolog distribution (narrow range ethoxylates, NRE). In addition to these nonionic surfactants, it is also possible to use fatty alcohols with more than 12 EO. Examples thereof are tallow fatty alcohol with 14 EO, 25 EO, 30 EO or 40 EO.

Furthermore, as further nonionic surfactants it is also possible to use alkyl glycosides of general formula $RO(G)_x$, in which R is a primary straight-chain or methyl-branched, in particular methyl-branched in the 2 position, aliphatic radical having 8 to 22, preferably 12 to 18, carbon atoms and G is the symbol which stands for a glycose unit having 5 or 6 carbon atoms, preferably glucose. The degree of oligomerization x, which gives the distribution of monoglycosides and oligoglycosides, is any number between 1 and 10; preferably, x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable. The amount of these nonionic surfactants is preferably not more than that of the ethoxylated fatty alcohols, in particular not more than half thereof.

Further suitable surfactants are polyhydroxy fatty acid amides of the formula (II),

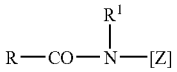

II in which RCO is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of the formula (III),

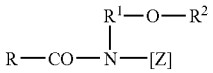

(III)

in which R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a reduced sugar, for example glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

Various nonionic surfactants can be applied depending on the subsequent intended use of the surfactant granulates produced according to the invention. The preferred surfactants used are weakly-foaming nonionic surfactants. The compositions produced according to the invention preferably comprise a nonionic surfactant which has a melting point above room temperature. Accordingly, preferred compositions produced according to the invention are characterized in that they comprise nonionic surfactant(s) with a melting point above 20° C., preferably above 25° C., particularly preferably between 25 and 60° C. and in particular between 26.6 and 43.3° C.

Suitable nonionic surfactants which have melting or softening points in the stated temperature range are, for example, weakly-foaming nonionic surfactants, which may be solid or highly viscous at room temperature. If nonionic surfactants which are highly viscous at room temperature are used, then it is preferred for them to have a viscosity above 20 Pas, preferably above 35 Pas and in particular above 40 Pas. Nonionic surfactants which have wax-like consistency at room temperature are also preferred.

Nonionic surfactants which are solid at room temperature and to be used preferably originate from the groups of alkoxylated nonionic surfactants, in particular the ethoxylated primary alcohols and mixtures of these surfactants with structurally complicated surfactants, such as polyoxypropylene/polyoxyethylene/polyoxypropylene (PO/EO/PO) surfactants. Such (PO/EO/PO) nonionic surfactants are characterized, moreover, by good foam control.

In a preferred embodiment of the present invention, the nonionic surfactant with a melting point above room temperature is an ethoxylated nonionic surfactant which has resulted from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol.

A particularly preferred nonionic surfactant which is solid at room temperature and to be used is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol, of ethylene oxide. Among these, the so-called "narrow range ethoxylates" (see above) are particularly preferred.

Accordingly, particularly preferred compositions produced according to the invention comprise ethoxylated nonionic surfactant(s) which has/have been obtained from $C_{6-20}$-monohydroxyalkanols or $C_{6-20}$-alkylphenols or $C_{16-20}$-fatty alcohols and more than 12 mol, preferably more than 15 mol and in particular more than 20 mol, of ethylene oxide per mole of alcohol.

The nonionic surfactant preferably additionally has propylene oxide units in the molecule. Preferably, such PO units constitute up to 25% by weight, particularly preferably up to 20% by weight and in particular up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules here constitutes preferably more than 30% by weight, particularly preferably more that 50% by weight and in particular more than 70% by weight, of the total molar mass of such nonionic surfactants. Preferred method end products of the method according to the invention with after-treatment step are characterized in that they comprise ethoxylated and propoxylated nonionic surfactants in which the propylene oxide units in the molecule constitute up to 25% by weight, preferably up to 20% by weight and in particular up to 15% by weight, of the total molar mass of the nonionic surfactant.

Further nonionic surfactants with melting points above room temperature to be used particularly preferably comprise 40 to 70% of a polyoxypropylene/polyoxyethylene/polyoxypropylene block polymer blend, which 75% by weight of an inverse block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mole of trimethylolpropane.

Nonionic surfactants which can be used particularly advantageously are available, for example, under the name Poly Tergent® SLF-18 from Olin Chemicals. A further preferred after-treated method end product according to the invention comprises nonionic surfactants of the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x has values between 0.5 and 1.5 and y is a value of at least 15.

Further nonionic surfactants which may preferably be used are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x is values between 1 and 30, k and j are values between 1 and 12, preferably between 1 and 5. If the value $x \geqq 2$, each $R^3$ in the above formula may be different. $R^1$ and $R^2$ are preferably linear or branched, saturated or unsaturated, aliphatic or aromatic hydrocarbon radicals having 6 to 22 carbon atoms, particular preference being given to radicals having 8 to 18 carbon atoms. For the radical $R^3$, H, —$CH_3$ or —$CH_2CH_3$ are particularly preferred. Particularly preferred values for x are in the range from 1 to 20, in particular from 6 to 15.

As described above, each $R^3$ in the above formula may be different, if x is $\geqq 2$. As a result of this, the alkylene oxide unit in the square brackets may be varied. If, for example, x is 3, the radical $R^3$ may be chosen in order to form ethylene oxide ($R^3$=H) or propylene oxide ($R^3$=$CH_3$) units, which can be added in any order, for example (EO)(PO)(EO), (EO)(EO)(PO), (EO)(EO)(EO), (PO)(EO)(PO), (PO)(PO)(EO) and (PO)(PO)(PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of k=1 and j=1, so that the above formula is simplified to $$R^1O[CH_2CH(R^3)O]_xCH_2CH(OH)CH_2OR^2.$$

In the last-mentioned formula, $R^1$, $R^2$ and $R^3$ are as defined above and x represents numbers from 1 to 30, preferably from 1 to 20 and in particular from 6 to 18. Particular preference is given to surfactants in which the radicals $R^1$ and $R^2$ have 9 to 14 carbon atoms, $R^3$ is H and x assumes values from 6 to 15.

Summarizing the last-mentioned statements, preference is given to compositions which are produced and after-treated in accordance with the invention and which comprise terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x stands for values between 1 and 30, k and j for values between 1 and 12, preferably between 1 and 5, particular preference being given to surfactants of the type $$R^1O[CH_2CH(R^3)O]_xCH_2CH(OH)CH_2OR^2$$

in which x stands for numbers from 1 to 30, preferably from 1 to 20 and in particular from 6 to 18.

In conjunction with said surfactants it is also possible to use cationic and/or amphoteric surfactants, these only being of-minor importance and in most cases only used in amounts below 10% by weight, in most cases even below 5% by weight, for example from 0.01 to 2.5% by weight, in each case based on the composition. The compositions produced according to the invention and optionally after-treated can thus also comprise cationic and/or amphoteric surfactants as surfactant component.

As cationic active substances, the compositions produced according to the invention and optionally after-treated can, for example, comprise cationic compounds of the formulae IV, V or VI:

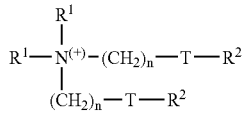

(IV)

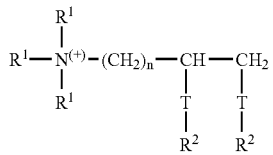

(V)

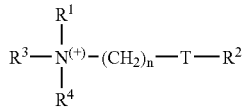

(VI)

in which each group $R^1$ is chosen independently of the others from $C_{1-6}$-alkyl, -alkenyl or -hydroxyalkyl groups; each group $R^2$ is chosen independently of the others from $C^{8-28}$-alkyl or -alkenyl groups; $R^3$=$R^1$ or $(CH_2)_n$—T—$R^2$; $R^4$=$R^1$ or $R^2$ or $(CH_2)_n$—T—$R^2$; T=—$CH_2$—, —O—CO— or —CO—O— and n is an integer from 0 to 5.

The anionic surfactant granulates produced according to the invention can—as described above—be processed directly to give detergents or cleaners by adding further customary ingredients of detergents or cleaners. They can, however, also be used as carrier bases for liquid or pasty substances, in particular nonionic surfactants and are then anionic surfactant/nonionic surfactant mixed compounds, which can likewise be mixed up to give detergents or cleaners.

The present invention therefore further provides detergents or cleaners which comprise a method end product of the method according to the invention.

Irrespective of whether the above-described after-treatment and supplying step is carried out on the method end products produced according to the invention or not, detergents or cleaners which comprise these method end products usually comprise further substances from the groups of builders, cobuilders, bleaches, bleach activators, dyes and fragrances, optical brighteners, enzymes, soil release polymers, etc. These substances are described below for the sake of completeness.

Builders are used in detergents or cleaners primarily for binding calcium and magnesium. Customary builders, which are present for the purposes of the invention preferably in amounts of from 22.5 to 45% by weight, preferably from 25 to 40% by weight and in particular from 27.5 to 35% by weight, in each case based on the total composition, which also comprises the method end products of the method according to the invention, are the low molecular weight polycarboxylic acids and their salts, the homopolymeric and copolymeric polycarboxylic acids and their salts, the carbonates, phosphates and sodium and potassium silicates. For detergents and cleaners, preference is given to using trisodium citrate and/or pentasodium tripolyphosphate and silicatic builders from the class of alkali metal disilicates. In general, with the alkali metal salts, the potassium salts are preferred over the sodium salts since they often have a greater solubility in water. Preferred water-soluble builders are, for example, tripotassium citrate, potassium carbonate and the potassium waterglasses.

Detergents or cleaners can comprise phosphates as builders, preferably alkali metal phosphates, particularly preferably pentasodium or pentapotassium triphosphate (sodium or potassium tripolyphosphate).

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, besides higher molecular weight representatives, may be differentiated. The phosphates combine a number of advantages: they act as alkali carriers, prevent limescale deposits and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 with sodium hydroxide solution and the slurry is sprayed. Potassium dihydrogenphosphate (primary or monobasic potassium phosphate, potassium biphosphate, KDP), $KH_2PO_4$, is a white salt of density 2.33 $gcm^{-3}$, has a melting point of 253° [decomposition with formation of potassium polyphosphate $(KPO_3)_x$] and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^{-3}$, water loss at 95°), 7 mol (density 1.68 $gcm^{-3}$, melting point 48° with loss of 5 $H_2O$) and 12 mol of water (density 1.52 $gcm^{-3}$, melting point 35° with loss of 5 $H_2O$), becomes anhydrous at 100° and converts to the diphosphate $Na_4P_2O_7$ upon more severe heating. Disodium hydrogenphosphate is prepared by neutralizing phosphoric acid with soda solution using phenolphthalein as indicator. Dipotassium hydrogenphosphate (secondary or dibasic potassium phosphate), $K_2HPO_4$, is an amorphous, white salt which is readily soluble in water.

Trisodium phosphate, tertiary sodium phosphate, $Na_3PO_4$, are colorless crystals which, as the dodecahydrate, have a density of 1.62 $gcm^{-3}$ and a melting point of 73–76° C. (decomposition), as the decahydrate (corresponding to 19–20% of $P_2O_5$) have a melting point of 100° C. and in anhydrous form (corresponding to 39–40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the detergents industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815–1.836 $gcm^{-3}$, melting point 94° with loss of water). Both substances are colorless crystals which are soluble in water with an alkaline reaction. $Na_4P_2O_7$ is formed when disodium phosphate is heated at >200° or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or high-temperature phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate) is a nonhygroscopic, white, water-soluble salt which is anhydrous or crystallizes with 6 $H_2O$ and has the general formula NaO—[P(O)(ONa)—$O_n$]—Na where n=3. About 17 g of the anhydrous salt dissolve in 100 g of water at room temperature, about 20 g dissolve at 60°, and about 32 g dissolve at 100°; after heating the solution for two hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is commercially available, for example, in the form of a 50% strength by weight solution (>23% $P_2O_5$, 25% $K_2O$). The potassium polyphosphates are widely used in the detergents and cleaners industry.

Preferred detergents or cleaners comprise 20 to 50% by weight of one or more water-soluble builders, preferably citrates and/or phosphates, preferably alkali metal phosphates, particularly preferably pentasodium or pentapotassium triphosphate (sodium or potassium tripolyphosphate).

In preferred embodiments of the present invention, the content of water-soluble builders in the compositions is within narrower limits. Preference is given here to detergents or cleaners which comprise the water-soluble builder (s) in amounts of from 22.5 to 45% by weight, preferably from 25 to 40% by weight and in particular from 27.5 to 35% by weight, in each case based on the total composition.

The compositions according to the invention can particularly advantageously comprise condensed phosphates as water-softening substances. These substances form a group of phosphates—also called fused or high-temperature phosphates due to their preparation—which can be derived from acidic salts of orthophosphoric acid (phosphoric acids) by condensation. The condensed phosphates can be divided into the metaphosphates $[M1n(PO_3)_n]$ and polyphosphates ($M^1_{n+2}P_nO_{3n+1}$ or $M_n^1H_2P_nO_{3n+1}$).

The term "metaphosphates" was originally the general name for condensed phosphates of the composition $M_n[P_nO_{3n}]$ (M=monovalent metal), but is nowadays mostly restricted to salts with ring-shaped cyclo(poly)phosphate anions. When n=3, 4, 5, 6, etc. the names are tri-, tetra-penta-, hexa-metaphosphates, etc. According to the systematic nomenclature of the isopolyanions, the anion where n=3 is, for example, referred to as cyclotriphosphate.

Metaphosphates are obtained as accompanying substances of the Graham's salt—incorrectly referred to as sodium hexametaphosphate—by melting $NaH_2PO_4$ at temperatures exceeding 620° C., where so-called Maddrell's salt is also formed as an intermediate. This salt and Kurrol's salt are linear polyphosphates which are nowadays mostly not included with the metaphosphates, but which can likewise be used advantageously as water-softening substances for the purposes of the present invention.

The crystalline, water-insoluble Maddrell's salt, $(NaPO_3)_x$ where x is >1000, which can be obtained at 200–300° C. from $NaH_2PO_4$, converts, at about 600° C., into the cyclic metaphosphate $[Na_3(PO_3)_3]$, which melts at 620° C. The quenched, glass-like melt is, depending on the reaction conditions, the water-soluble Graham's salt $(NaPO_3)_{40-50}$, or a glass-like condensed phosphate of the composition $(NaPO_3)_{15-20}$, which is known as Calgon. For both products, the erroneous name hexametaphosphate is still in use. The so-called Kurrol's salt, $(NaPO_3)_n$ where n is ≧5000, likewise arises from the 600° C. hot melt of the Maddrell's salt if this is left for a short time at about 500° C. It forms highly polymeric water-soluble fibers.

Water-softening substances from the above-mentioned classes of condensed phosphates which have proven to be particularly preferred are the "hexametaphosphates" Budit® H6 and H8 from Budenheim.

Besides the builders, bleaches, bleach activators, enzymes, silver protectants, dyes and fragrances, etc. in particular are preferred ingredients. In addition, further ingredients may be present, preference being given to compositions which, besides the end products of the method according to the invention, additionally comprise one or more substances from the group of acidifying agents, chelate complexing agents or of film-inhibiting polymers.

Possible acidifiers are either inorganic acids or organic acids provided these are compatible with the other ingredients. For reasons of consumer protection and handling safety, the solid mono-, oligo- and polycarboxylic acids in particular can be used. From this group, preference is in turn given to citric acid, tartaric acid, succinic acid, malonic acid, adipic acid, maleic acid, fumaric acid, oxalic acid, and polyacrylic acid. The anhydrides of these acids can also be used as acidifiers, maleic anhydride and succinic anhydride in particular being commercially available. Organic sulfonic acids, such as amidosulfonic acid can likewise be used. A composition which is commercially available and which can likewise preferably be used as acidifier for the purposes of the present invention is Sokalan® DCS (trademark of BASF), a mixture of succinic acid (max. 31% by weight), glutaric acid (max. 50% by weight) and adipic acid (max. 33% by weight).

A further possible group of ingredients are the chelate complexing agents. Chelate complexing agents are substances which form cyclic compounds with metal ions, where a single ligand occupies more than one coordination site on a central atom, i.e. is at least "bidentate". In this case, stretched compounds are thus normally closed by complex formation via an ion to give rings. The number of bonded ligands depends on the coordination number of the central ion.

Chelate complexing agents which are customary and preferred for the purposes of the present invention are, for example, polyoxycarboxylic acids, polyamines, ethylenediaminetetraacetic acid (EDTA) and nitrilotriacetic acid (NTA). Complex-forming polymers, i.e. polymers which carry functional groups either in the main chain itself or laterally relative to this, which can act as ligands and react with suitable metal atoms usually to form chelate complexes, can also be used according to the invention. The polymer-bonded ligands of the resulting metal complexes can originate from just one macromolecule or else belong to different polymer chains. The latter leads to crosslinking of the material, provided the complex-forming polymers have not already been crosslinked beforehand via covalent bonds.

Complexing groups (ligands) of customary complex-forming polymers are iminodiacetic acid, hydroxyquinoline, thiourea, guanidine, dithiocarbamate, hydroxamic acid, amidoxime, aminophosphoric acid, (cycl.) polyamino, mercapto, 1,3-dicarbonyl and crown ether radicals, some of which have very specific activities toward ions of different metals. Basis polymers of many complex-forming polymers, which are also commercially important, are polystyrene, polyacrylates, polyacrylonitriles, polyvinyl alcohols, polyvinylpyridines and polyethylenimines. Natural polymers, such as cellulose, starch or chitin are also complex-forming polymers. Moreover, these may be provided with further ligand functionalities as a result of polymer-analogous modifications.

For the purposes of the present invention, particular preference is given to detergents or cleaners which comprise one or more chelate complexing agents from the groups of (i) polycarboxylic acids in which the sum of the carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids, and
(vi) cyclodextrins in amounts above 0.1% by weight, preferably above 0.5% by weight, particularly preferably above 1% by weight and in particular above 2.5% by weight, in each case based on the weight of the dishwasher composition.

For the purposes of the present invention, it is possible to use all complexing agents of the prior art. These may belong to different chemical groups. Preference is given to using the following, individually or in a mixture with one another:

a) polycarboxylic acids in which the sum of the carboxyl and optionally hydroxyl groups is at least 5, such as gluconic acid,
b) nitrogen-containing mono- or polycarboxylic acids, such as ethylenediaminetetraacetic acid (EDTA), N-hydroxyethylethylenediaminetriacetic acid, diethylenetriaminepentaacetic acid, hydroxyethyliminodiacetic acid, nitridodiacetic acid-3-propionic acid, isoserinediacetic acid, N,N-di(β-hydroxyethyl)glycine, N-(1,2-dicarboxy-2-hydroxyethyl)glycine, N-(1,2-dicarboxy-2-hydroxyethyl)aspartic acid or nitrilotriacetic acid (NTA),
c) geminal diphosphonic acids, such as 1-hydroxyethane-1,1-diphosphonic acid (HEDP), higher homologs thereof having up to 8 carbon atoms, and hydroxy or amino group-containing derivatives thereof and 1-aminoethane-1,1-diphosphonic acid, higher homologs thereof having up to 8 carbon atoms, and hydroxy or amino group-containing derivatives thereof,
d) aminophosphonic acids, such as ethylenediaminetetra (methylenephosphonic acid), diethylenetriaminepenta (methylenephosphonic acid) or nitrilotri(methylenephosphonic acid),
e) phosphonopolycarboxylic acids, such as 2-phosphonobutane-1,2,4-tricarboxylic acid, and
f) cyclodextrins.

For the purposes of this patent application, polycarboxylic acids a) are understood as meaning carboxylic acids—including monocarboxylic acids—in which the sum of carboxyl and the hydroxyl groups present in the molecule is at least 5. Complexing agents from the group of nitrogen-containing polycarboxylic acids, in particular EDTA, are preferred. At the alkaline pH values of the treatment solutions required according to the invention, these complexing agents are at least partially in the form of anions. It is unimportant whether they are introduced in the form of acids or in the form of salts. In the case of using salts, alkali metal, ammonium or alkylammonium salts, in particular sodium salts, are preferred.

Film-inhibiting polymers may likewise be present in the compositions according to the invention. These substances, which may have chemically different structures, originate, for example, from the groups of low molecular weight polyacrylates with molar masses between 1000 and 20 000 daltons, preference being given to polymers with molar masses below 15 000 daltons.

Film-inhibiting polymers may also have cobuilder properties. Organic cobuilders which may be used in the method end products according to the invention are, in particular, polycarboxylates/polycarboxylic acids, polymeric polycarboxylates, aspartic acid, polyacetals, dextrins, further organic cobuilders (see below) and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is to be made of citric acid, succinic acid, glutaric acid, adipic acid, gluconic acid and any mixtures thereof.

Also suitable as builders or film inhibitors are polymeric polycarboxylates; these are, for example, the alkali metal salts of polyacrylic acid or of polymethacrylic acid, for example those having a relative molecular mass of from 500 to 70 000 g/mol.

The molar masses given for polymeric polycarboxylates are, for the purposes of this specification, weight-average molar masses $M_w$ of the respective acid form, determined fundamentally by means of gel permeation chromatography (GPC) using a WV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 2000 to 20 000 g/mol. Owing to their superior solubility, preference in this group may be given in turn to the short-chain polyacrylates which have molar masses of from 2000 to 10 000 g/mol and particularly preferably from 3000 to 5000 g/mol.

Also suitable are copolymeric polycarboxylates, in particular those of acrylic acid with methacrylic acid and of acrylic acid or methacrylic acid with maleic acid. Copolymers which have proven to be particularly suitable are those of acrylic acid with maleic acid which contain from 50 to 90% by weight of acrylic acid and 50 to 10% by weight of maleic acid. Their relative molecular mass, based on free acids, is generally 2000 to 70 000 g/mol, preferably 20 000 to 50 000 g/mol and in particular 30 000 to 40 000 g/mol.

The (co)polymeric polycarboxylates can either be used as powders or as aqueous solutions. The (co)polymeric polycarboxylate content of the agents is preferably 0.5 to 20% by weight, in particular 3 to 10% by weight.

Particular preference is also given to biodegradable polymers of more than two different monomer units, for example those which contain, as monomers, salts of acrylic acid or of maleic acid, and vinyl alcohol or vinyl alcohol derivatives, or those which contain, as monomers, salts of acrylic acid and of 2-alkylallylsulfonic acid, and sugar derivatives. Further preferred copolymers are those which preferably have, as monomers, acrolein and acrylic acid/acrylic acid salts or acrolein and vinyl acetate.

Further preferred builder substances which are likewise to be mentioned are polymeric aminodicarboxylic acids, salts thereof or precursor substances thereof. Particular preference is given to polyaspartic acids or salts and derivatives thereof, which also have a bleach-stabilizing effect as well as cobuilder properties.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes, such as glyoxal, glutaraldehyde, terephthalaldehyde, and mixtures thereof and from polyolcarboxylic acids, such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with customary processes, for example acid-catalyzed or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is also possible to use maltodextrins with a DE between 3 and 20 and dried glucose syrups with a DE between 20 and 37, and also so-called yellow dextrins and white dextrins with relatively high molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on the $C_6$ of the saccharide ring may be particularly advantageous.

Oxydisuccinates and other derivatives of disuccinates, preferably ethylenediaminedisuccinate, are also further suitable cobuilders. Here, ethylenediamine N,N'-disuccinate (EDDS) is preferably used in the form of its sodium or magnesium salts. In this connection, preference is also given to glycerol disuccinates and glycerol trisuccinates. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups.

A further class of substances with cobuilder properties is the phosphonates. These are, in particular, hydroxyalkane- and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as the hexasodium salt of EDTMP or as the hepta- and octasodium salt of DTPMP. Here, preference is given to using HEDP as builder from the class of phosphonates. In addition, the aminoalkanephosphonates have a marked heavy metal-binding capacity. Accordingly, particularly if the compositions also comprise bleaches, it may be preferable to use aminoalkanephosphonates, in particular DTPMP, or mixtures of said phosphonates.

In addition to the substances from said classes of substance, the compositions according to the invention can comprise further customary ingredients of cleaners, bleaches, bleach activators, enzymes, silver protectants, dyes and fragrances in particular being of importance. These substances are described below.

Among the compounds which serve as bleaches and liberate $H_2O_2$ in water, sodium perborate tetrahydrate and sodium perborate monohydrate are of particular importance. Examples of further bleaches which may be used are sodium percarbonate, peroxypyrophosphates, citrate perhydrates, and $H_2O_2$-supplying peracidic salts or peracids, such as perbenzoates, peroxophthalates, diperazelaic acid, phthaloiminoperacid or diperdodecanedioic acid. Detergents or cleaners according to the invention can also comprise bleaches from the group of organic bleaches. Typical organic bleaches are the diacyl peroxides, such as, for example, dibenzoyl peroxide. Further typical organic bleaches are the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-napthoic acid and magnesium monoperphthalate, (b) the aliphatic or substituted aliphatic peroxy acids, such as peroxylauric acid, peroxystearic acid, ε-phthalimido-peroxycaproic acid [phthaloiminoperoxyhexanoic acid (PAP)], o-carboxybenzamidoperoxycaproic acid, N-nonenylamidoperadipic acid and N-nonenylamido-persuccinates, and (c) aliphatic and araliphatic peroxydicarboxylic acids, such as 1,12-diperoxy-carboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyl-di(6-aminopercaproic acid) can be used.

Bleaches which may be used in the machine dishwashing detergents according to the invention may also be substances which liberate chlorine or bromine. Suitable materials which liberate chlorine or bromine are, for example, heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Bleach activators assist the effect of the bleaches. Known bleach activators are compounds which contain one or more N- or O-acyl groups, such as substances from the class of anhydrides, of esters, of imides and of acylated imidazoles or oximes. Examples are tetra-acetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

Bleach activators which can be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O- and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- and iso-NOBS), carboxylic anhydrides, in particular phthalic anhydride, acylated polyhydric alcohols, in particular triacetin, ethylene glycol diacetate, 2,5-diacetoxy-2,5-dihydrofuran, n-methyhnorpholinium acetonitrile methylsulfate (MMA), and enol esters, and acetylated sorbitol and mannitol and mixtures thereof (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam. Hydrophilically substituted acylacetals and acyllactams are likewise preferably used. Combinations of conventional bleach activators can also be used.

In addition to the conventional bleach activators, or instead of them, so-called bleach catalysts may also be present in the compositions according to the invention. These substances are bleach-boosting transition metal salts or transition metal complexes, such as, for example Mn—, Fe—, Co—, Ru— or Mo-salen complexes or -carbonyl complexes. Mn, Fe, Co, Ru, Mo, Ti, V and Cu complexes with N-containing tripod ligands, and Co—, Fe—, Cu— and Ru-ammine complexes can also be used as bleach catalysts.

Preference is given to using bleach activators from the group of polyacylated alkylenediamines, in particular tetraacetylethylenediamine (TAED), N-acylimides, in particular N-nonanoylsuccinimide (NOSI), acylated phenolsulfonates, in particular n-nonanoyl- or isononanoyloxybenzenesulfonate (n- or iso-NOBS), n-methylmorpholinium acetonitrile methylsulfate (MMA), preferably in amounts up to 10% by weight, in particular 0.1% by weight to 8% by weight, particularly 2 to 8% by weight and particularly preferably 2 to 6% by weight, based on the total composition.

Bleach-boosting transition metal complexes, in particular with the central atoms Mn, Fe, Co, Cu, Mo, V, Ti and/or Ru, preferably chosen from the group of manganese and/or cobalt salts and/or complexes, particularly preferably the cobalt (ammine) complexes, the cobalt (acetato) complexes, the cobalt (carbonyl) complexes, the chlorides of cobalt or of manganese, of manganese sulfate are used in customary amounts, preferably in an amount up to 5% by weight, in particular from 0.0025% by weight to 1% by weight and particularly preferably from 0.01% by weight to 0.25% by weight, in each case based on the total composition. However, in special cases, more bleach activator can also be used.

Suitable enzymes in the detergents or cleaners according to the invention are, in particular, those from classes of hydrolases, such as the proteases, esterases, lipases or lipolytic enzymes, amylases, glycosyl hydrolases and mixtures of said enzymes. All of these hydrolases contribute to the removal of soilings, such as protein-, grease- or starch-containing stains. For bleaching, it is also possible to use oxidoreductases. Especially suitable enzymatic active ingredients are those obtained from bacterial strains or fungi, such as Bacillus subtilis, Bacillus licheniformis, Streptomyces griseus, Coprinus cinereus and Humicola insolens, and from genetically modified variants thereof. Preference is given to using proteases of the subtilisin type and in particular to proteases obtained from Bacillus lentus. Of particular interest here are enzyme mixtures, for example protease and amylase or protease and lipase or lipolytic enzymes or of protease, amylase and lipase or lipolytic enzymes or protease, lipase or lipolytic enzymes, but in particular protease and/or lipase-containing mixtures or mixtures containing lipolytic enzymes. Examples of such lipolytic enzymes are the known cutinases. Peroxidases or oxidases have also proven suitable in some cases. Suitable amylases include, in particular, alpha-amylases, isoamylases, pullulanases and pectinases.

The enzymes can be adsorbed on carrier substances or embedded in coating substances in order to protect them against premature decomposition. The proportion of the enzymes, enzyme mixtures or enzyme granulates can, for example, be about 0.1 to 5% by weight, preferably 0.5 to about 4.5% by weight, in each case based on the ready-formulated detergent or cleaner.

Dyes and fragrances can be added to the detergents or cleaners according to the invention in order to improve the esthetic impression of the resulting products and to provide the consumer not only with performance, but a visually and sensorially "typical and unmistakable" product. Perfume oils or fragrances which may be used are individual odorant compounds, e.g. the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether, and the aldehydes include, for example, the linear alkanals having 8–18 carbon atoms, citral, citronellal, citronellyloxyacetaldehyde, cyclamenaldehyde, hydroxycitronellal, lilial and bourgeonal, and the ketones include, for example, the ionones, α-isomethylionone and methyl cedryl ketone, and the alcohols include anethole, citronellol, eugenol, geraniol, linalool, phenylethyl alcohol and terpineol, and the hydrocarbons include primarily the terpenes, such as limonene, and pinene. However, preference is given to mixtures of different odorants which together produce a pleasing scent note. Such perfume oils can also contain natural odorant mixtures, as are obtainable from plant sources, e.g. pine oil, citrus oil, jasmine oil, patchouli oil, rose oil and ylang ylang oil. Likewise suitable are muscatel, sage oil, chamomile oil, oil of cloves, balm oil, mint oil, cinnamon leaf oil, lime blossom oil, juniper berry oil, vetiver oil, olibanum oil, galbanum oil and labdanum oil, and orange blossom oil, neroli oil, orange peel oil and sandalwood oil.

The fragrances can be incorporated directly into the compositions according to the invention, although it may also be advantageous to apply the fragrances to carriers which enhance the adhesion of the perfume to the laundry and, as a result of slower fragrance release, ensure long-lasting scent on the textiles. Such carrier materials which have proven useful are, for example, cyclodextrins, where the cyclodextrin-perfume complexes can also additionally be coated with further auxiliaries.

In order to improve the esthetic impression of the compositions prepared according to the invention, it (or parts thereof) may be colored with suitable dyes. Preferred dyes, the selection of which does not present the person skilled in the art with any difficulty, have high storage stability and insensitivity toward the other ingredients of the compositions and toward light, and do not have marked substantivity toward the substrates to be treated with the compositions, such as glass, ceramic or plastic dishware so as not to dye these.

To protect the ware or the machine, the detergents or cleaners according to the invention may comprise corrosion inhibitors, silver protectants in particular being of particular importance in the area of machine dishwashing. The known substances of the prior art can be used. In general, it is primarily possible to use silver protectants chosen from the group of triazoles, of benzotriazoles, of bisbenzotriazoles, of aminotriazoles, of alkylaminotriazoles and of transition metal salts or complexes. Particular preference is given to using benzotriazole and/or alkylaminotriazole. Moreover, cleaning formulations often contain active-chlorine-containing agents which are able to clearly prevent corrosion of the silver surface. In chlorine-free cleaners, oxygen- and nitrogen-containing organic redox-active compounds, such as di- and trihydric phenols, e.g. hydroquinone, pyrocatechol, hydroxyhydroquinone, gallic acid, phloroglucine, pyrogallol or derivatives of these classes of compounds are particularly. Salt-like and complex-like organic compounds, such as salts of the metals Mn, Ti, Zr, Hf, V, Co and Ce are also often used. Preference is given here to the transition metal salts which are chosen from the group of manganese and/or cobalt salts and/or complexes, particularly preferably the cobalt (ammine) complexes, the cobalt (acetate) complexes, the cobalt (carbonyl) complexes, the chlorides of cobalt or manganese and manganese sulfate. It is likewise possible to use zinc compounds to prevent corrosion on the ware.

Detergents according to the invention can comprise derivatives of diaminostilbenedisulfonic acid or alkali metal salts thereof as optical brighteners. Suitable examples are salts of 4,4'-bis(2-anilino-4-morpholino-1,3,5-triazinyl-6-amino)stilbene-2,2'-disulfonic acid or similarly constructed compounds which bear a diethanolamino group, a methylamino group, an anilino group or a 2-methoxyethylamino group instead of the morpholino group. In addition, brighteners of the substituted diphenylstyryl type may also be present, e.g. the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the abovementioned brighteners can also be used.

The method end products of the method according to the invention can not only be added to particulate detergents or cleaners, but can also be used in detergent or cleaner tablets. Surprisingly, the solubility of such tablets is improved through the use of the method end products of the method according to the invention compared with tablets which are equally as hard and have an identical composition but comprise no end products of the method according to the invention. The present invention therefore further provides for the use of the method end products of the method according to the invention for producing detergents, in particular detergent tablets.

The production of such tablets using the method end products according to the invention is described below.

Washing- and cleaning-active shaped bodies are produced by applying pressure to a mixture to be compressed that is located in the cavity of a press. In the simplest case of shaped-body production, which is simply called tableting below, the mixture to be tableted is compressed directly, i.e. without prior granulation. The advantages of this so-called direct tableting are its simple and cost-effective application since no other process steps and, consequently, no additional equipment either are required. However, these advantages are also countered by disadvantages. For example, a powder mixture which is to be tableted directly is required to have sufficient plastic deformability and to have good flow properties; furthermore, it must not exhibit any separation tendencies whatsoever during storage, transportation, and the filling of the die. With many mixtures of the substances, these three prerequisites can only be managed with extreme difficulty, meaning that direct tableting, especially for the production of detergent and cleaner tablets is seldom used. The usual route for producing detergent and cleaner tablets starts, therefore, from pulverulent components ("primary particles"), which by means of suitable techniques are agglomerated or granulated to form secondary particles with a greater particle diameter. These granulates, or mixtures of different granulates, are then mixed with individual pulverulent adjuvants and passed on for tableting. For the purposes of the present invention, this means that the method end product of the method according to the invention are worked up with further ingredients, which can likewise be in granular form, to give a premix.

Prior to the compression of the particulate premix to give detergent and cleaner shaped bodies, the premix may be "powdered" with finely divided surface treatment agents. This may be advantageous for the nature and physical properties both of the premix (storage, compression) and of the finished detergent and cleaner shaped bodies. Finely divided powdering agents have long been known in the prior art, with zeolites, silicates or other inorganic salts usually being used. Preferably, however, the premix is "powdered" with finely divided zeolite, preference being given to zeolites of the faujasite type. In the context of the present invention, the term "zeolite of the faujasite type" characterizes all three zeolites which form the faujasite subgroup of the zeolite structure group 4 (compare Donald W. Breck: "Zeolite Molecular Sieves", John Wiley & Sons, New York, London, Sydney, Toronto, 1974, page 92). Besides the zeolite X, it is thus also possible to use zeolite Y and faujasite, and mixtures of these compounds, preference being given to pure zeolite X.

Mixtures or cocrystallisates of zeolites of the faujasite type with other zeolites, which do not necessarily have to belong to the zeolite structure group 4, may also be used as powdering agents, it being advantageous for at least 50% by weight of the powdering agent to consist of a zeolite of the faujasite type.

For the purposes of the present invention, preference is given to detergents and cleaners which consist of a particulate premix which comprises granular components and pulverulent substances admixed subsequently, where the subsequently admixed, or one of the subsequently admixed, pulverulent components is a zeolite of the faujasite type with particle sizes less than 100 μm, preferably less than 10 μm and in particular less than 5 μm, and constitutes at least 0.2% by weight, preferably at least 0.5% by weight and in particular more than 1% by weight of the premix to be compressed.

Besides the end products of the method according to the invention, the premixes to be compressed can additionally comprise one or more substances from the group of bleaches, bleach activators, enzymes, pH regulators, fragrances, perfume carriers, fluorescent agents, dyes, foam inhibitors, silicone oils, antiredeposition agents, optical brighteners, graying inhibitors, color transfer inhibitors and corrosion inhibitors. These substances have been described above.

The shaped bodies according to the invention are produced first of all by the dry mixing of the constituents, some or all of which may have been pregranulated, and subsequent shaping, in particular compression to give tablets, in which case recourse may be had to conventional processes. To produce the shaped bodies according to the invention, the premix is compacted in a so-called die between two punches to form a solid compact. This operation, referred to below for short as tableting, is divided into four sections: metering, compaction (elastic deformation), plastic deformation, and ejection.

Firstly, the premix is introduced into the die, the fill amount and thus the weight and the shape of the resulting shaped body being determined by the position of the lower punch and the shape of the compression tool. Consistent metering even at high shaped-body throughputs is achieved preferably by volumetric metering of the premix. In the subsequent course of tableting, the upper punch contacts the premix and is lowered further in the direction of the lower punch. During this compression, the particles of the premix are pressed close together, with a continual reduction in the cavity volume within the filling between the punches. From a certain position of the upper punch (and thus from a certain pressure on the premix), plastic deformation begins, in which the particles coalesce and the shaped body is formed. Depending on the physical properties of the premix, some of the premix particles are also crushed, and at even higher pressures, sintering of the premix occurs. As the compression speed increases, i.e. at high throughputs, the phase of the elastic deformation becomes shorter and shorter, so that the resulting shaped bodies may have larger or smaller cavities. In the final step of tableting, the finished shaped body is ejected from the die by the lower punch and is conveyed away by subsequent transport devices. At this point in time, only the weight of the shaped body is ultimately fixed, since owing to physical processes (re-expansion, crystallographic effects, cooling, etc.) the compacts may still change their shape and size.

The tableting takes place in standard commercial tableting presses, which may in principle be equipped with single or double punches. In the latter case the upper punch is not used alone to build up pressure; the lower punch, as well, moves toward the upper punch during the compression operation, while the upper punch presses downward. For small production volumes it is preferred to use eccentric tableting presses, where the punch or punches is or are fastened to an eccentric disk which is itself mounted on an axle with a certain speed of revolution. The movement of these compression punches is comparable with the way in which a customary four-stroke engine operates. Compression may take place with one upper punch and one lower punch, or else a plurality of punches may be fastened to one eccentric disk, in which case the number of die bores is increased accordingly. The throughputs of eccentric presses vary, depending on model, from several hundred to a maximum of 3000 tablets per hour.

For larger throughputs, rotary tableting presses are chosen, in which a larger number of dies is arranged in a circle on a so-called die table. Depending on model, the number of dies varies between 6 and 55, with larger dies also being commercially available. Each die on the die table is allocated an upper and lower punch, it being possible in turn for the compressive pressure to be built up actively only by the upper punch or lower punch, or else by both punches. The die table and the punches move around a common vertical axis, the punches being brought into the filling, compaction, plastic deformation and ejection positions, during revolution, with the aid of rail like cam tracks. At the positions necessitating a considerable lifting or lowering of the punches (filling, compaction, ejection), these cam tracks are assisted by additional low-pressure sections, low tension rails and discharge tracks. The die is filled by way of a rigid feed device, the so-called filling shoe, which is connected to a reservoir container for the premix. The compressive pressure on the premix can be adjusted individually for the upper and lower punches by way of the compression paths, the buildup of pressure taking place by the rolling of the punch shaft heads past adjustable pressure rolls.

In order to increase the throughput, rotary presses may also be provided with two filling shoes, in which case only a half-circle need be traveled in order to produce one tablet. For the production of two-layer and multilayer shaped bodies, a plurality of filling shoes is arranged in series, with the slightly compressed first layer not being ejected before the subsequent filling. By means of an appropriate process regime, it is also possible in this way to produce laminated tablets and inlay tablets having a structure like that of an onion skin, where in the case of the inlay tablets the top face of the core, or of the core layers, is not covered and therefore remains visible. Rotary tableting presses may also be equipped with single or multiple tools, so that, for example, an outer circle with 50 bores and an inner circle with 35 bores are used simultaneously for compression. The throughputs of modern rotary tableting presses amount to more than one million shaped bodies per hour.

When tableting with rotary presses, it has been found advantageous to carry out tableting with the lowest possible fluctuations in tablet weight. In this way, it is also possible to reduce fluctuations in tablet hardness. Slight fluctuations in weight can be achieved as follows:

- use of plastic inserts with small thickness tolerances
- low rotor speed
- large filling shoes
- harmonization between the filling shoe wing rotary speed and the speed of the rotor
- filling shoe with constant powder height
- decoupling of filling shoe and powder charge To reduce caking on the punches, all of the anti-adhesion coatings known from the prior art are available. Polymer coatings, polymer inserts or plastic punches are particularly advantageous. Rotating punches have also proven to be advantageous, in which case, where possible, upper punch and lower punch should be rotatable in design. In the case of rotating punches, it is generally possible to dispense with a plastic insert. In this case, the punch surfaces should be electropolished.

It has also been found that long compression times are advantageous. These can be established using pressure rails, a plurality of pressure rolls or low rotor speeds. Since the fluctuations in the tablet hardness are caused by the fluctuations in the compressive forces, systems should be used which limit the compressive force. In this case it is possible to use elastic punches, pneumatic compensators, or sprung elements in the force path. In addition, the pressure roll may be of sprung design.

Tableting machines suitable for the purposes of the present invention are available, for example, from Apparatebau Holzwarth GbR, Asperg, Wilhelm Fette GmbH, Schwarzenbek, Hofer GmbH, Weil, Horn & Noack Pharmatechnik GmbH, Worms, IMA Verpackungssysteme GmbH Viersen, KILIAN, Cologne, KOMAGE, Kell am See, KORSCH Pressen AG, Berlin and Romaco GmbH, Worms. Examples of further suppliers are Dr. Herbert Pete, Vienna (AU), Mapag Maschinenbau AG, Bern (CH), BWI Manesty, Liverpool (GB), I. Holand Ltd., Nottingham (GB), Courtoy Nev., Halle (BE/LU) and Mediopharm Kamnik (SI). A particularly suitable apparatus is, for example, the hydraulic double-pressure press HPF 630 from LAEIS, D. Tableting tools are available, for example, from Adams Tablettierwerkzeuge, Dresden, Wilhelm Fett GmbH, Schwarzenbek, Klaus Hammer, Solingen, Herber % Söhne GmbH, Hamburg, Hofer GmbH, Weil, Horn & Noack, Pharmatechnik GmbH, Worms, Ritter Pharamatechnik GmbH, Hamburg, Romaco, GmbH, Worms and Notter Werkzeugbau, Tamm. Further suppliers are, for example, Senss AG, Reinach (CH) and Medicopharm Kamnik (SI).

The shaped bodies can be produced here in predetermined three-dimensional shapes and predetermined sizes. Suitable three-dimensional shapes are virtually all practicable designs, thus, for example, bar, rod or ingot form, cubes, blocks and corresponding three-dimensional elements having planar side faces, and in particular cylindrical designs with a circular or oval cross section. This latter design covers forms ranging from tablets through to compact cylinders having a height-to-diameter ratio of more than 1.

The portioned compacts may in each case be formed as separate individual elements corresponding to the predetermined dosage amount of the detergents and/or cleaners. It is equally possible, however, to design compacts that combine a plurality of such mass units in one compact, with the ease of separation of smaller, portioned units being provided for in particular by means of predetermined breakage points. For the use of textile detergents in machines of the type customary in Europe, with a horizontally arranged mechanism, it may be judicious to design the portioned compacts as tablets, in cylindrical or block form, preference being given to a diameter/height ratio in the range from about 0.5:2 to 2:0.5. Commercially available hydraulic presses, eccentric presses or rotary presses are suitable devices in particular for producing such compacts.

The three-dimensional shape of another embodiment of the shaped bodies is adapted in its dimensions to the dispenser drawer of standard commercial domestic washing machines, so that the shaped bodies can be metered without a dosing aid directly into the dispenser drawer, where they dissolve during the rinse-in operation. However, it is also of course possible without problems, and preferred for the purposes of the present invention, to use the detergent shaped bodies by way of a dosing aid.

A further preferred shaped body which can be produced has a plate-like or bar-like structure with alternating thick, long and thin, short segments, so that individual segments can be broken off from this "slab" at the predetermined breaking points, represented by the short thin segments, and inserted into the machine. This principle of the "slab-like" shaped body detergent can also be realized in other geometric shapes, for example vertical triangles joined to one another lengthwise along just one of their sides.

However, it is also possible for the various components not to be compressed to a uniform tablet, but for shaped bodies to be obtained which have a plurality of layers, i.e. at least two layers. In this case it is also possible for these different layers to have different dissolution rates. This may result in advantageous performance properties for the shaped bodies. If, for example, there are components present in the shaped bodies which have an adverse effect on one another, then it is possible to integrate one component into the more quickly-dissolving layer and the other component into a slower-dissolving layer, so that the first component has already reacted when the second component passes into solution. The layer structure of the shaped bodies may be realized in stack-form, in which case a dissolution operation of the inner layer(s) at the edges of the shaped body takes place before the outer layers have completely dissolved; however, the inner layer(s) may also be completely enveloped by the respective outerlying layer(s), which prevents premature dissolution of the constituents of the inner layer (s).

In a further preferred embodiment of the invention, a shaped body consists of at least three layers, i.e. two outer layers and at least one inner layer, with at least one of the inner layers comprising a peroxy bleach, while in the stack-form shaped body the two outer layers, and in the case of the envelope-form shaped body, the outermost layers, are free from peroxy bleach. In addition, it is also possible to spatially separate peroxy bleach and any bleach activators and/or enzymes present in a shaped body. Multilayer shaped bodies of this type have the advantage that they can not only be used by way of a dispenser drawer or by way of a dosing device which is placed into the wash liquor; instead, in such cases it is also possible to place the shaped body into the machine in direct contact with the textiles without fear of spotting by bleaches and the like.

Similar effects can also be achieved by coating individual constituents of the detergent and cleaner composition to be compressed or the entire shaped body. For this purpose, the bodies to be coated can, for example, be sprayed with aqueous solutions or emulsions, or else a coating obtained via the process of hot-melt coating.

After compression, the detergent and cleaner shaped bodies have high stability. The fracture strength of cylindrical shaped bodies can be ascertained by way of the parameter of the diametral fracture stress. This can be determined by $$\sigma = \frac{2P}{\pi D t}$$

where σ represents the diametral fracture stress (DFS) in Pa, P is the force in N which leads to the pressure exerted on the shaped body and causes it to fracture, D is the diameter of the shaped body in meters, and t is the height of the shaped bodies.

The disclosures of each patent, patent application, and publication cited or described in this document are hereby incorporated herein by reference, in their entireties.

Various modifications of the invention, in addition to those described herein, will be apparent to those skilled in the art from the foregoing description. Such modifications are also intended to fall within the scope of the appended claims.

What is claimed is:

1. A method for producing surfactant granulates, comprising:

providing a mixture of anionic surfactant acids and builder acids having a weight ratio of 1:100 to 1:20 of builder acid to surfactant acid;

foaming the builder acid and the anionic surfactant acid; and neutralizing the mixture with at a solid bed comprising least one solid neutralizing agent;

wherein said builder acid is citric acid, tartaric acid, succinic acid, malonic acid, adipic acid, maleic acid, fumaric acid, oxalic acid, gluconic acid, nitrilotriacetic acid, aspartic acid, ethylenediaminetetraacetic acid, aminotrimethylenephosphonic acid, hydroxyethanediphosphonic acid, polyaspartic acids, polyacrylic acids, polymethacrylic acids, or copolymers thereof;

wherein the builder acid has a particle size below 200 μm.

2. The method of claim 1, wherein the anionic surfactant acid is selected from the group consisting of carboxylic acids, sulfuric half-esters, sulfonic acids, fatty acids, fatty alkylsulfuric acids, alkylarylsulfonic acids, and mixtures thereof.

3. The method of claim 1, wherein the anionic surfactant acid is $C_{8-16}$-alkylbenzenesulfonic acid.

4. The method of claim 1, wherein the mixture has a temperature of from 15 to 70° C. when added to the solid bed.

5. The method of claim 1, wherein the solid bed further comprises silicates, aluminum silicates, sulfates, citrates and/or phosphates.

6. The method of claim 1, wherein the resulting foam has a density below 0.80 $gcm^{-3}$.

7. The method of claim 1, wherein the resulting foam has average pore sizes below 10 mm.

8. The method of claim 1, wherein the solid neutralizing agents include at least one of sodium hydroxide, sodium sesquicarbonate, potassium hydroxide, or potassium carbonate.

9. The method of claim 1, wherein the solid neutralizing agents include sodium carbonate which reacts at least proportionally to give sodium hydrogencarbonate.

10. The method of claim 9, further comprising controlling reaction conditions such that the ratio of the weight fractions of sodium carbonate to sodium hydrogencarbonate is 2:1 or more.

11. The method of claim 9, wherein the content of sodium hydrogencarbonate in the method end products is 0.5 to 40% by weight of the method end products.

12. The method of claim 9, wherein the water content of the method end products is <15% by weight.

13. The method of claim 1 wherein the builder acid has a particle size below 150 μm.

14. The method of claim 1 wherein the builder acid has a particle size below 100 μm.

15. The method of claim 1, wherein the method end products have a bulk density of 300 to 1000 g/l.

* * * * *